US011679947B2

(12) United States Patent
Saito

(10) Patent No.: US 11,679,947 B2
(45) Date of Patent: Jun. 20, 2023

(54) IMAGE FORMING APPARATUS

(71) Applicant: TOSHIBA TEC KABUSHIKI KAISHA, Tokyo (JP)

(72) Inventor: Yuichi Saito, Numazu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 27 days.

(21) Appl. No.: 17/482,499

(22) Filed: Sep. 23, 2021

(65) Prior Publication Data

US 2022/0009733 A1 Jan. 13, 2022

Related U.S. Application Data

(63) Continuation of application No. 16/790,782, filed on Feb. 14, 2020, now Pat. No. 11,155,426.

(51) Int. Cl.
*B65H 3/06* (2006.01)
*B65H 5/06* (2006.01)

(52) U.S. Cl.
CPC ..... *B65H 3/0638* (2013.01); *B65H 5/06* (2013.01); *B65H 2402/31* (2013.01); *B65H 2601/324* (2013.01)

(58) Field of Classification Search
CPC ..... B65H 3/0638; B65H 2402/31; B65H 2601/324
See application file for complete search history.

(56) References Cited

U.S. PATENT DOCUMENTS

| | | | | |
|---|---|---|---|---|
| 5,421,569 | A | 6/1995 | Davidson | |
| 6,059,280 | A | 5/2000 | Yamauchi et al. | |
| 6,488,276 | B2 | 12/2002 | Sheng et al. | |
| 8,079,586 | B2 | 12/2011 | Watanabe et al. | |
| 2002/0096819 | A1* | 7/2002 | Fukasawa | B65H 3/5223 271/121 |
| 2017/0115616 | A1 | 4/2017 | Suto et al. | |

FOREIGN PATENT DOCUMENTS

JP 02-082881 6/1990

OTHER PUBLICATIONS

Non-Final Office Action for U.S. Appl. No. 16/790,782 dated Mar. 1, 2021.

* cited by examiner

*Primary Examiner* — Howard J Sanders
(74) *Attorney, Agent, or Firm* — Amin, Turocy & Watson, LLP

(57) ABSTRACT

According to one embodiment, an image forming apparatus includes a support shaft, a connecting member, and a detachable member. The support shaft extends in a first direction. The support shaft includes a protrusion. The protrusion protrudes in a second direction orthogonal to the first direction. The connecting member is formed of an elastic material. The connecting member interposes the protrusion therebetween. The connecting member is connected to the support shaft to surround an outer periphery of the support shaft. The detachable member is detachably connected to the support shaft via the connecting member.

13 Claims, 17 Drawing Sheets

IMAGE FORMING APPARATUS

CROSS-REFERENCE TO RELATED APPLICATION

This application is a Continuation of application Ser. No. 16/790,782 filed on Feb. 14, 2020, the entire contents of which are incorporated herein by reference.

FIELD

Embodiments described herein relate generally to an image forming apparatus, a sheet conveying apparatus, and a sheet conveying apparatus.

BACKGROUND

A rotation separation method is known as a sheet feeding separation mechanism in an image forming apparatus. In the rotation separation system, a separation roller including a torque limiter is pressed against a sheet feeding roller. A frictional coefficient of the separation roller and the sheet feeding roller with respect to the sheet is larger than a friction coefficient between the sheets.

When the sheet is not interposed between the separation roller and the sheet feeding roller, or one sheet is interposed therebetween, a rotational drive force received by the separation roller via the sheet feeding roller or the sheet exceeds setting torque of the torque limiter. As a result, the separation roller rotates with the sheet feeding roller and rotates in a direction opposite to the sheet feeding roller. Thus, when one sheet is interposed therebetween, the sheet is fed.

On the other hand, when two sheets enter between the separation roller and the sheet feeding roller, slip occurs between the sheets and the separation roller stops. Accordingly, double feeding of the lower layer sheet is prevented.

The separation roller is supported to be swingable centering on a swing fulcrum provided in a downstream direction of a sheet conveyance direction, and energized toward the sheet feeding roller by a spring.

Separation performance of the separation roller deteriorates when the friction coefficient of a surface of the separation roller changes due to wear. Therefore, it is required to replace the separation roller having progressed wear.

For example, the separation roller is held by a holder having a joint detachably connected to a swing support shaft provided in a sheet feeding unit. A C-shaped joint is often used as the joint. The C-shaped joint is fitted to be swingable to an outer peripheral surface of the swing support shaft.

For example, the C-shaped joint is formed of an elastically deformable material, and an opening unit in a radial direction is made slightly smaller than an outer diameter of the swing support shaft, such that the joint can be attached and detached to and from the swing support shaft. Here, the opening unit of the joint is moved forward and backward with respect to the swing support shaft, thereby being attached and detached. Since the joint should be elastically deformed at the time of attachment and detachment, a large force is required to some extent.

DETAILED DESCRIPTION

In general, according to one embodiment, an image forming apparatus includes a support shaft, a connecting member, and a detachable member. The support shaft extends in a first direction. The support shaft includes a protrusion. The protrusion protrudes in a second direction orthogonal to the first direction. The connecting member is formed of an elastic material. The connecting member interposes the protrusion therebetween. The connecting member is connected to the support shaft to surround an outer periphery of the support shaft. The detachable member is detachably connected to the support shaft via the connecting member.

Embodiment

Hereinafter, an image forming apparatus according to an embodiment will be described with reference to the drawings.

Figure 1:
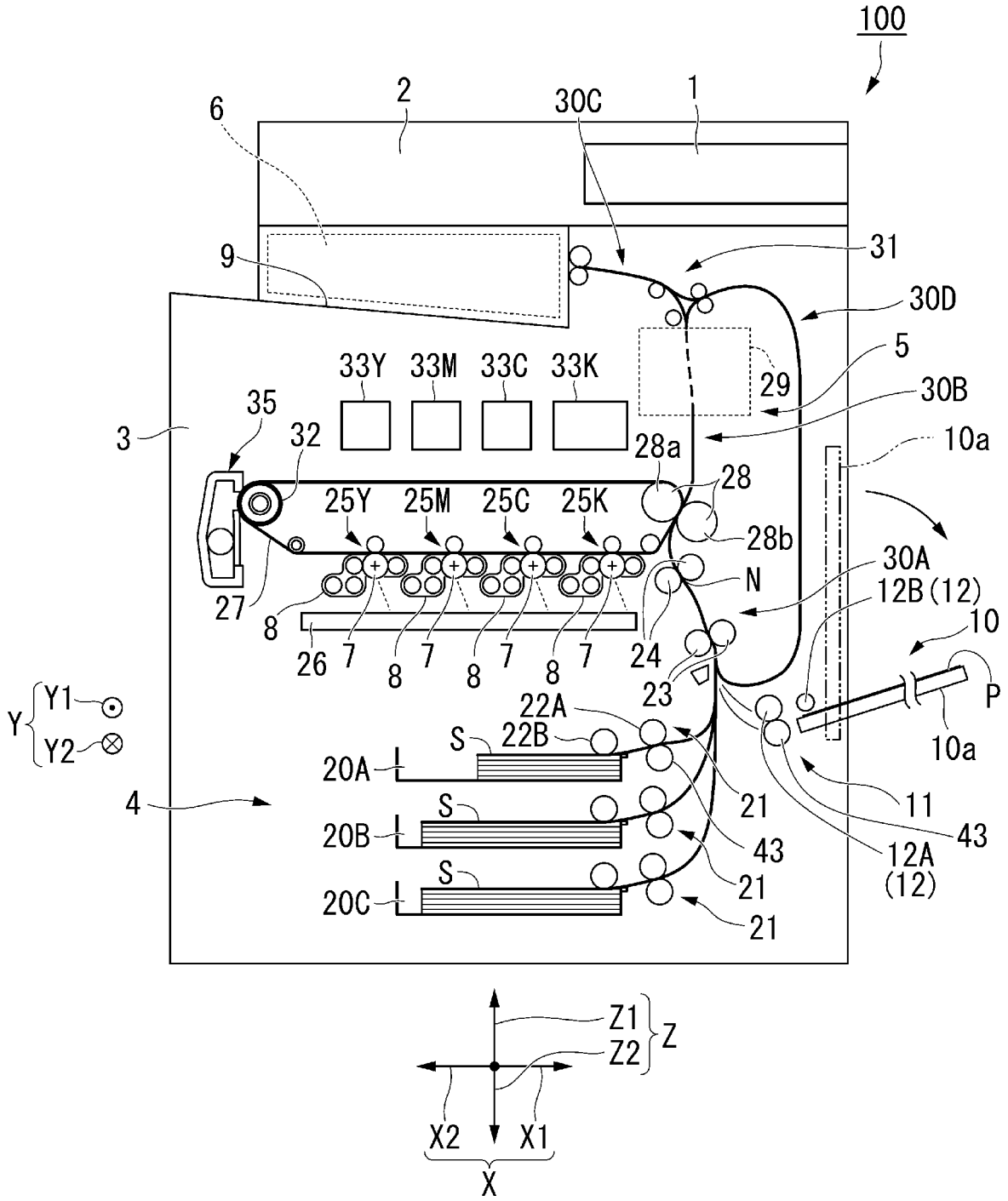
FIG. 1 is a schematic cross-sectional view illustrating an example of an overall configuration of an image forming apparatus according to an embodiment.

FIG. 1 is a schematic cross-sectional view illustrating an example of an overall configuration of an image forming apparatus according to an embodiment. In the following drawings, the same or corresponding component will be denoted by the same reference sign unless otherwise specified.

As illustrated in FIG. 1, an image forming apparatus 100 according to the embodiment includes a control panel 1, a scanner unit 2, a printer unit 3, a sheet supply unit 4, a conveyance unit 5, a manual feeding unit 10, and a main body control unit 6.

Hereinafter, when referring to a relative position in the image forming apparatus 100, X1, X2, Y1, Y2, Z1, and Z2 directions illustrated in the drawing may be used. The X1 direction is a direction from the left to the right when standing on the front side of the image forming apparatus 100 (front side of a sheet surface of FIG. 1). The X2 direction is opposite to the X1 direction. The Y1 direction is a direction from the back surface of the image forming apparatus 100 to the front surface thereof. The Y2 direction is opposite to the Y1 direction. The Z1 direction is a vertically upward direction. The Z2 direction is a vertically downward direction. When the directions of the X1 (Y1, Z1) direction and the X2 (Y2, Z2) direction are not considered or when both directions are included, the directions thereof are simply referred to as the X (Y, Z) direction.

Hereinafter, a plane having a normal line in the X direction is referred to as a YZ plane, a plane having a normal line in the Y direction is referred to as a ZX plane, and a plane having a normal line in the Z direction is referred to as an XY plane. The ZX plane is a plane parallel to a conveyance direction of a sheet S which will be described later in the image forming apparatus 100. The XY plane is a horizontal plane.

The control panel 1 operates the image forming apparatus 100 when a user performs an operation.

The scanner unit 2 reads image information of a target to be copied based upon brightness and darkness of light. The scanner unit 2 outputs the read image information to the printer unit 3.

The printer unit 3 forms an image on the sheet S based upon the image information from the scanner unit 2 or from the outside.

The printer unit 3 forms an output image (toner image) with a developer containing toner. The printer unit 3 transfers the toner image to the surface of the sheet S. The printer unit 3 fixes the toner image on the sheet S by applying heat and pressure to the toner image on the surface of the sheet S.

The sheet supply unit 4 supplies the sheets S one by one to the printer unit 3 in response to the timing when the printer unit 3 forms the toner image.

The sheet supply unit 4 includes sheet feeding cassettes 20A, 20B, and 20C, and a plurality of cassette sheet feeding units 21 (sheet feeding units).

The sheet feeding cassettes 20A, 20B, and 20C store the sheets S of various sizes.

The plurality of cassette sheet feeding units 21 are respectively disposed above end parts in the X1 direction of the sheet feeding cassettes 20A, 20B, and 20C. Each of the cassette sheet feeding units 21 includes a pickup roller 22B, a sheet feeding roller 22A, and a separation roller 43.

Each pickup roller 22B conveys the sheet S necessary for image formation from the sheet feeding cassettes 20A, 20B, and 20C to a nip part between the sheet feeding roller 22A and the separation roller 43.

Each sheet feeding roller 22A conveys the sheet S conveyed to the nip part to the conveyance unit 5.

Each separation roller 43 separates one sheet S from the two sheets S by a rotation separation method when the two sheets S are conveyed to the nip part. Therefore, the separation roller 43 is rotatably supported to be able to press the sheet feeding roller 22A, and is energized toward the sheet feeding roller 22A with an approximately constant force by a spring which will be described later. The separation roller 43 is configured not to rotate in an opposite direction to the sheet feeding roller 22A at an inter-sheet frictional force generated between the sheets S interposed between the sheet feeding roller 22A and the separation roller 43. The separation roller 43 is configured such that a frictional force larger than the inter-sheet frictional force is generated between the separation roller 43 and the sheet S abutting thereon.

As a result, when the two sheets S are conveyed between the sheet feeding roller 22A and the separation roller 43 by the pickup roller 22B, one sheet S abutting on the sheet feeding roller 22A is conveyed by a conveyance force of the sheet feeding roller 22A while slipping with the sheet S on the lower layer side. Meanwhile, the sheet S on the lower layer side is stopped together with the separation roller 43. Therefore, even though the two sheets S are conveyed between the sheet feeding roller 22A and the separation roller 43, only one sheet S abutting on the sheet feeding roller 22A is separated.

A detailed configuration of the cassette sheet feeding unit 21 will be described after describing an overall configuration of the image forming apparatus 100.

The conveyance unit 5 includes a conveyance roller 23 and a registration roller 24. The conveyance unit 5 conveys the sheet S supplied from the sheet supply unit 4 to the registration roller 24.

The registration roller 24 conveys the sheet S in response to the timing at which the printer unit 3 transfers the toner image to the sheet S.

The conveyance roller 23 abuts a tip in the conveyance direction of the sheet S against a nip N of the registration roller 24. The conveyance roller 23 adjusts a position of the tip of the sheet S in the conveyance direction by bending the sheet S.

The registration roller 24 aligns the tip of the sheet S fed from the conveyance roller 23 at the nip N. The registration roller 24 conveys the sheet S to the side of a transfer unit 28 which will be described later.

The conveyance unit 5 includes conveyance paths 30A, 30B, 30C, and 30D. The conveyance paths 30A, 30B, 30C, and 30D will be described after describing other configurations of the printer unit 3.

The printer unit 3 includes image forming units 25Y, 25M, 25C, and 25K, an exposure unit 26, an intermediate transfer belt 27, a transfer unit 28, a fixing device 29, and a transfer belt cleaning unit 35.

The image forming units 25Y, 25M, 25C, and 25K are disposed in this order in the X1 direction.

Each of the image forming units 25Y, 25M, 25C, and 25K forms the toner image to be transferred to the sheet S on the intermediate transfer belt 27.

The image forming units 25Y, 25M, 25C, and 25K respectively include a photosensitive drum 7. The image forming units 25Y, 25M, 25C, and 25K form yellow, magenta, cyan, and black toner images on the respective photosensitive drums 7.

A charging device, a developing device 8, a primary transfer roller, a cleaning unit, and a charge removing device are respectively disposed around each photosensitive drum 7. The primary transfer roller is opposite to the photosensitive drum 7. The intermediate transfer belt 27 is interposed between the primary transfer roller and the photosensitive drum 7. The exposure unit 26 is disposed below the charging device and the developing device 8.

Toner cartridges 33Y, 33M, 33C, and 33K are disposed above the image forming units 25Y, 25M, 25C, and 25K. The toner cartridges 33Y, 33M, 33C, and 33K respectively contain yellow, magenta, cyan, and black toners.

The respective toners of the toner cartridges 33Y, 33M, 33C, and 33K are supplied to the image forming units 25Y, 25M, 25C, and 25K by a toner supply pipe (not illustrated).

The exposure unit 26 irradiates a surface of each charged photosensitive drum 7 with laser light. The laser light is controlled to emit light based upon the image information. The exposure unit 26 can also adopt a configuration in which LED light is emitted instead of the laser light. In the example illustrated in FIG. 1, the exposure unit 26 is disposed below the image forming units 25Y, 25M, 25C, and 25K.

The image information corresponding to yellow, magenta, cyan, and black is supplied to the exposure unit 26, respectively.

The exposure unit 26 forms an electrostatic latent image based upon the image information on the surface of each photosensitive drum 7.

The intermediate transfer belt 27 is formed of an endless belt. Tension is applied to the intermediate transfer belt 27 by a plurality of rollers abutting on an inner peripheral surface thereof. The intermediate transfer belt 27 is stretched flat. The inner peripheral surface of the intermediate transfer belt 27 abuts on a support roller 28*a* at a position in the X1 direction that is most separated in a stretching direction. The inner peripheral surface of the intermediate transfer belt 27 abuts on a transfer belt roller 32 at a position in the X2 direction that is most separated in the stretching direction.

The support roller 28*a* forms a part of the transfer unit 28 which will be described later. The support roller 28*a* guides the intermediate transfer belt 27 to a secondary transfer position.

The transfer belt roller 32 guides the intermediate transfer belt 27 to a cleaning position.

On the lower surface side of the intermediate transfer belt 27 in the drawing, the image forming units 25Y, 25M, 25C, and 25K excluding the primary transfer roller are disposed in this order in the X1 direction. The image forming units 25Y, 25M, 25C, and 25K are disposed with a space therebetween in a region between the transfer belt roller 32 and the support roller 28*a*.

When the toner image reaches a primary transfer position, a transfer bias is applied to each primary transfer roller of the image forming units 25Y, 25M, 25C, and 25K. Each primary transfer roller transfers (primary transfer) the toner image on the surface of each photosensitive drum 7 to the intermediate transfer belt 27.

In the intermediate transfer belt 27, the transfer unit 28 is disposed at a position adjacent to the image forming unit 25K.

The transfer unit 28 includes the support roller 28*a* and a secondary transfer roller 28*b* (roller). The secondary transfer roller 28*b* and the support roller 28*a* interpose the intermediate transfer belt 27. A position where the secondary transfer roller 28*b* and the intermediate transfer belt 27 abut on each other is the secondary transfer position.

The transfer unit 28 transfers the charged toner image on the intermediate transfer belt 27 to the surface of the sheet S at the secondary transfer position. The transfer unit 28 applies the transfer bias to the secondary transfer position. The transfer unit 28 transfers the toner image on the intermediate transfer belt 27 to the sheet S by the transfer bias.

The fixing device 29 applies heat and pressure to the sheet S. The fixing device 29 fixes the toner image transferred to the sheet S by the heat and the pressure. The fixing device 29 is disposed above the transfer unit 28.

The transfer belt cleaning unit 35 is opposite to the transfer belt roller 32. The transfer belt cleaning unit 35 interposes the intermediate transfer belt 27. The transfer belt cleaning unit 35 scrapes off the toner on the surface of the intermediate transfer belt 27.

The conveyance paths 30A and 30B for conveying the sheet S upward from below are respectively formed in this order between the registration roller 24 and the transfer unit 28 and between the transfer unit 28 and the fixing device 29.

The conveyance path 30C for discharging the sheet S in the X2 direction is formed above the fixing device 29. A discharge tray 9 on which the sheet S discharged from the conveyance path 30C is placed is provided below the exit in the X2 direction of the conveyance path 30C.

A conveyance direction switching unit 31 that switches the conveyance direction of the sheet S is provided above the fixing device 29.

The conveyance path 30D that conveys the sheet S from the conveyance direction switching unit 31 to the registration roller 24 is formed inside the printer unit 3 on the X1 direction side further away from the conveyance paths 30A and 30B. For example, when performing double-sided printing, the conveyance path 30D is used for reversing the sheet S where an image is formed on its surface and for feeding the reversed sheet S to the registration roller 24.

Each of the conveyance paths 30A, 30B, 30C, and 30D includes conveyance guide units that are opposite to each other with the sheet S interposed therebetween, and a conveyance roller provided as necessary.

The manual feeding unit 10 supplies a sheet P on which the image is formed to the printer unit 3.

The manual feeding unit 10 includes a manual feeding tray 10*a* and a manual sheet feeding unit 11 (sheet feeding unit).

The manual feeding tray 10*a* can rotate with a rotation axis extending in the Y direction as a center. When the manual feeding tray 10*a* is used, as indicated with a solid line, the manual feeding tray 10*a* is rotated in the clockwise direction and opened. The sheets P having various sizes can be placed on the opened manual feeding tray 10*a*.

When the manual feeding tray 10*a* is not used, as indicated with a two-dot chain line, the manual feeding tray 10*a* is rotated in the counterclockwise direction in the drawing and is housed in the side part in the X1 direction of the printer unit 3.

The manual sheet feeding unit 11 separates and feeds the sheet P placed on the manual feeding tray 10*a* and conveys the sheet P toward the registration roller 24. A separation method of the sheet P in the manual sheet feeding unit 11 uses the same rotation separation method described above as that of the cassette sheet feeding unit 21.

The manual sheet feeding unit 11 includes a manual sheet feeding roller unit 12 and the separation roller 43. The manual sheet feeding roller unit 12 includes a pickup roller 12B and a sheet feeding roller 12A.

The pickup roller 12B and the sheet feeding roller 12A have the same configuration as that of the pickup roller 22B and the sheet feeding roller 22A except for feeding the sheet P.

The separation roller 43 in the manual sheet feeding unit 11 has the same configuration as that of the separation roller 43 in the cassette sheet feeding unit 21 except that the separation roller 43 abuts on the sheet feeding roller 12A.

A detailed configuration of the manual sheet feeding unit 11 will be described after describing the overall configuration of the image forming apparatus 100.

The main body control unit 6 controls each apparatus unit of the image forming apparatus 100.

Next, a detailed configuration of the cassette sheet feeding unit 21 will be described.

Figure 2:
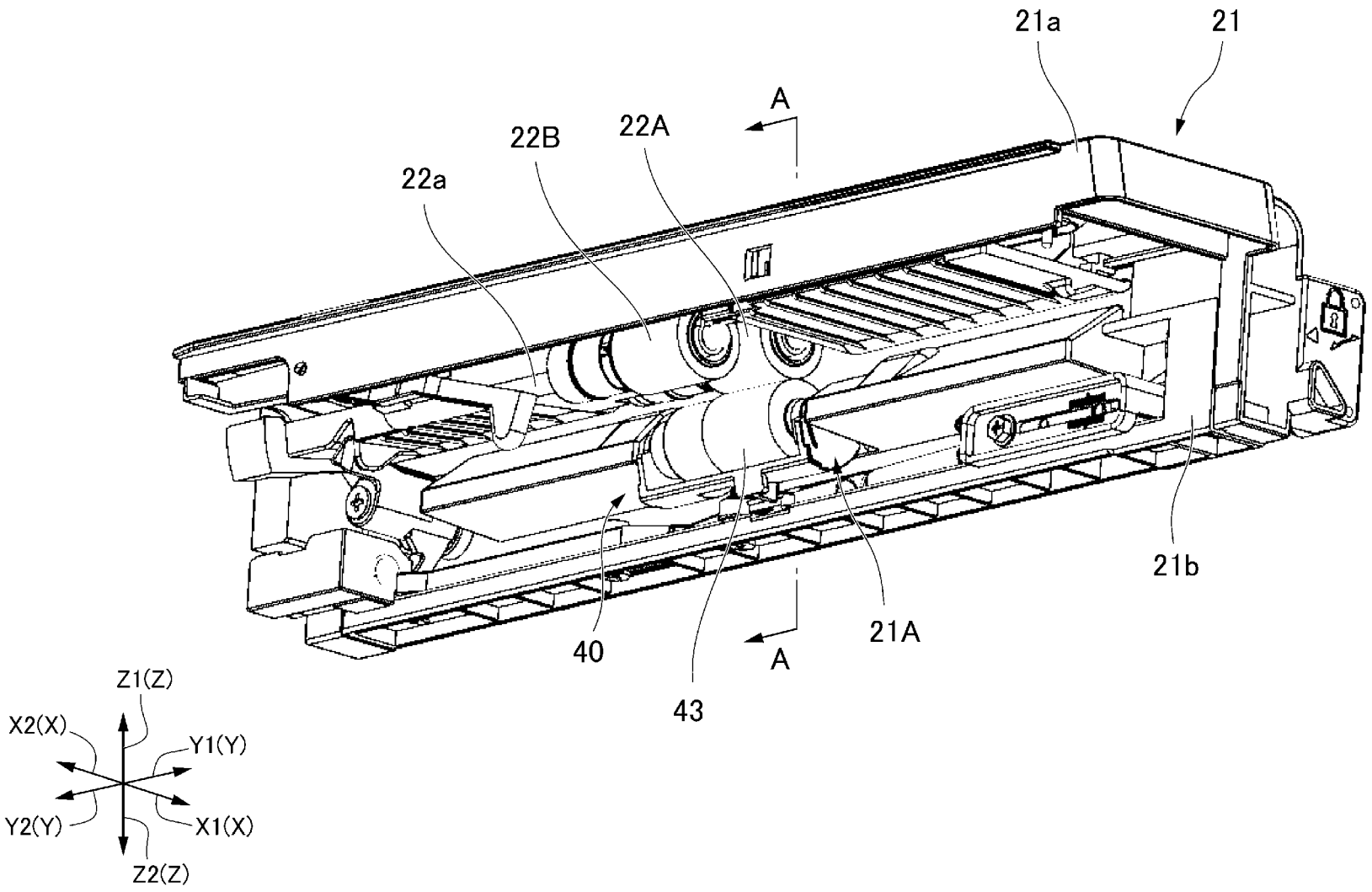
FIG. 2 is a schematic perspective view illustrating an example of a cassette sheet feeding unit (sheet feeding unit) of the apparatus.
Figure 3:
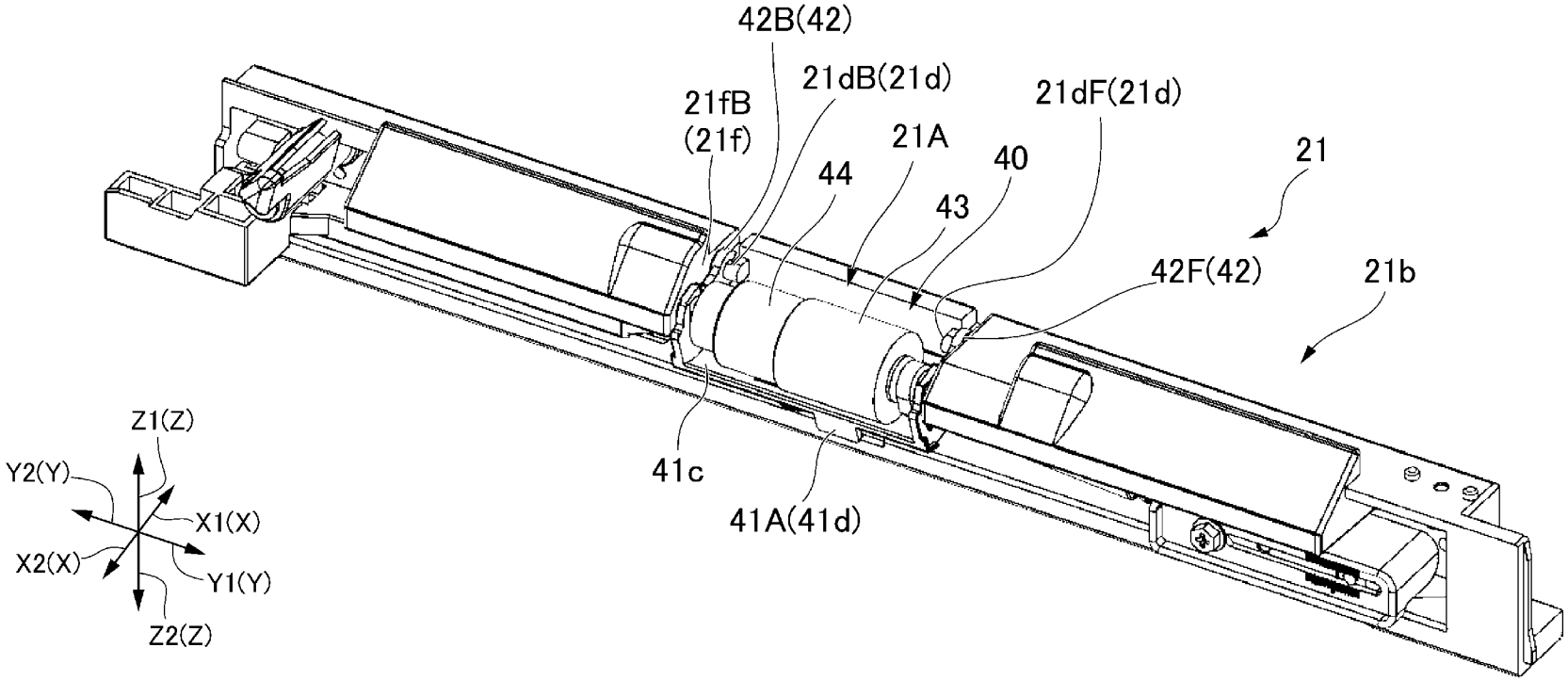
FIG. 3 is a schematic perspective view illustrating an example of a stay of the cassette sheet feeding unit.

FIG. 2 is a schematic perspective view illustrating an example of a cassette sheet feeding unit (sheet feeding unit) in the image forming apparatus of the embodiment. FIG. 3 is a schematic perspective view illustrating an example of a stay of the cassette sheet feeding unit in the image forming apparatus of the embodiment.

As illustrated in FIG. 2, the cassette sheet feeding unit 21 further includes an upper cover 21*a* and a stay 21*b*.

The cassette sheet feeding unit 21 is fixed to a printer main body unit which is not illustrated between a front side plate and a rear side plate, which are not illustrated, of the printer unit 3.

The upper cover 21*a* is a plate shaped member that is long in the Y direction. The upper cover 21*a* is longer than a conveyance width of the sheet S which is not illustrated. The upper cover 21*a* is disposed to cover the sheet feeding roller 22A and the pickup roller 22B from above.

The sheet feeding roller 22A is fixed to a tip in the Y1 direction of a drive shaft 22*a* extending in the Y direction on the lower side of the center part in the longitudinal direction of the upper cover 21*a*. The drive shaft 22*a* receives a drive force from a drive motor which is not illustrated in the printer main body unit, and rotates the sheet feeding roller 22A.

The pickup roller 22B is provided to be swingable centering on the rotation center of the sheet feeding roller 22A. The pickup roller 22B is connected to the sheet feeding roller 22A via a transmission mechanism. The pickup roller 22B rotates in the same direction as that of the sheet feeding roller 22A in association with the rotation of the sheet feeding roller 22A.

The stay 21*b* has the approximately same length as that of the upper cover 21*a*. The stay 21*b* is fixed to the upper cover 21*a* at the lower side of an end part in the X1 direction of the upper cover 21*a*.

As illustrated in FIG. 3, a separation roller unit housing unit 21A is formed at a center part in the longitudinal direction of the stay 21*b*. The separation roller unit housing unit 21A detachably houses a separation roller unit 40 (detachable member) including the separation roller 43.

A detailed configuration of the separation roller unit housing unit 21A will be described with reference to FIGS. 4 to 6.

Figure 4:
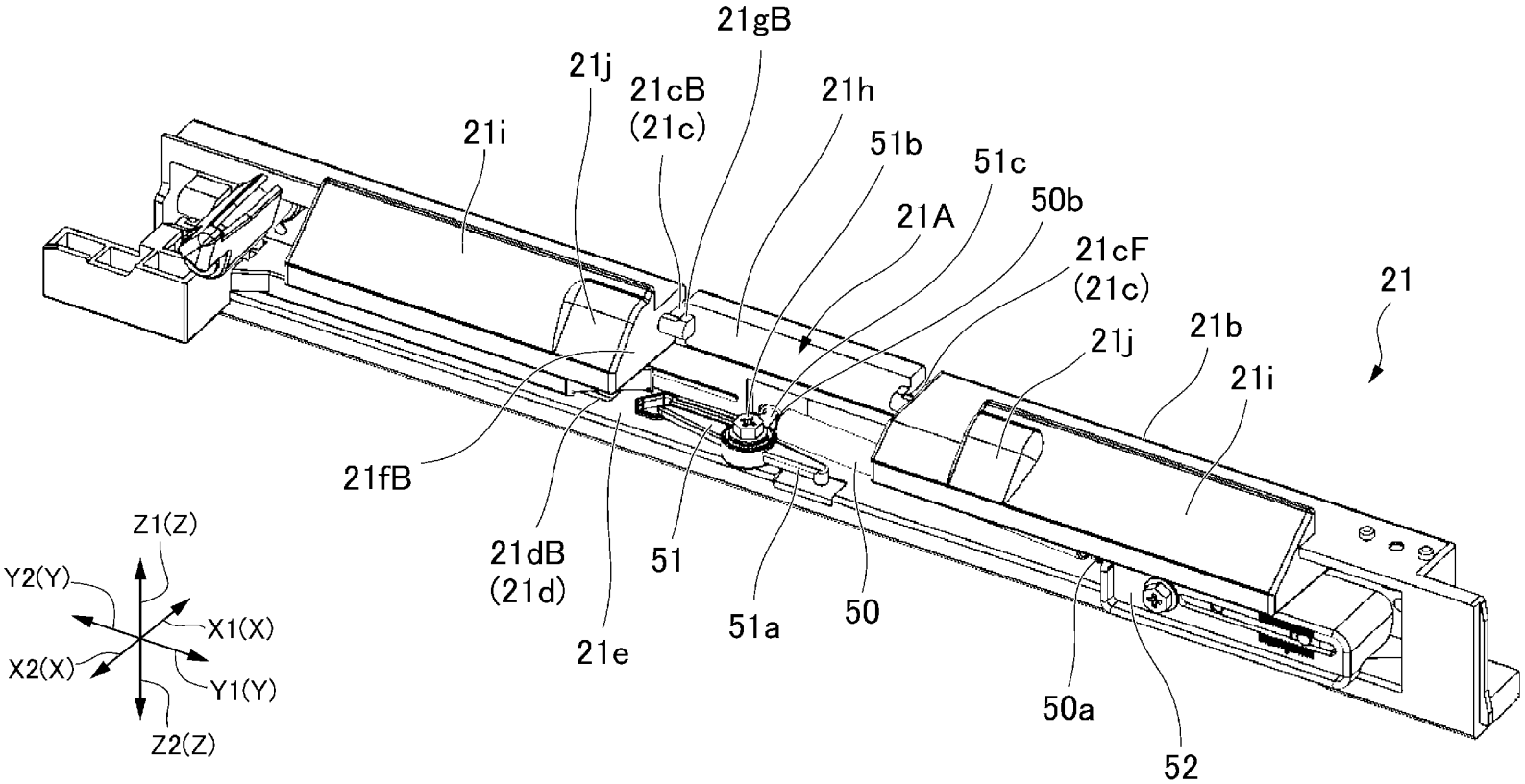
FIG. 4 is a schematic perspective view illustrating an example of a detachable member housing unit and a pressurizing mechanism provided in the cassette sheet feeding unit.

FIG. 4 is a schematic perspective view illustrating an example of a detachable member housing unit and a pressurizing mechanism provided in the cassette sheet feeding unit in the image forming apparatus of the embodiment. FIG. 5 is a schematic perspective view illustrating an example of the detachable member housing unit provided in the cassette sheet feeding unit in the image forming apparatus of the embodiment. FIG. 6 is a schematic diagram of a cross section taken along the line A-A of FIG. 2.

Figure 5:
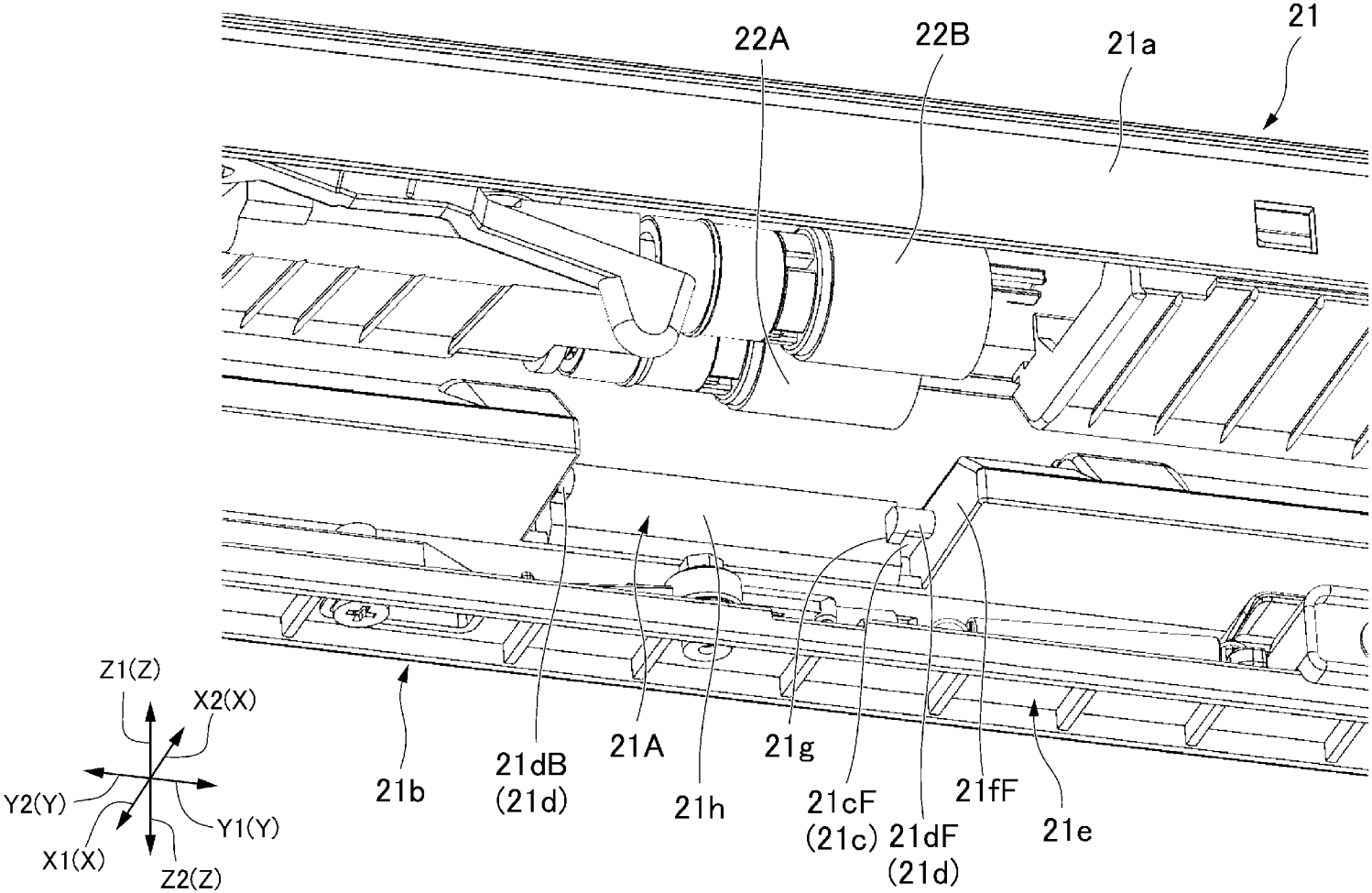
FIG. 5 is a schematic perspective view illustrating an example of the detachable member housing unit provided in the cassette sheet feeding unit.

As illustrated in FIGS. 4 and 5, the separation roller unit housing unit 21A (detachable member housing unit) is a recessed part facing a bottom surface part 21*e* of the stay 21*b* when viewed in the Z2 direction.

The separation roller unit housing unit 21A is formed to be surrounded by a first wall body 21*f*F (refer to FIG. 5), a second wall body 21*f*B (refer to FIG. 4), and a third wall body 21*h*.

The separation roller unit housing unit 21A is opened in the Z1 direction and the X2 direction.

The first wall body 21*f*F and the second wall body 21*f*B are flat plate units parallel to the ZX plane. The first wall body 21*f*F and the second wall body 21*f*B have the same outer shape as each other when viewed from the Y direction. The first wall body 21*f*F and the second wall body 21*f*B are opposite to each other in the Y direction. The first wall body 21*f*F is disposed on the Y1 direction side of the separation roller unit housing unit 21A. The second wall body 21*f*B is disposed on the Y2 direction side of the separation roller unit housing unit 21A.

The third wall body 21*h* is a flat plate unit parallel to the YZ plane. The third wall body 21*h* is disposed to be interposed between the respective end parts on the X1 direction side of the first wall body 21*f*F and the second wall body 21*f*B.

Both end parts in the Y direction of the third wall body 21*h* may be respectively joined to the first wall body 21*f*F and the second wall body 21*f*B. However, in the examples illustrated in FIGS. 4 and 5, both end parts in the Y direction of the third wall body 21*h* are separated from the first wall body 21*f*F and the second wall body 21*f*B.

As illustrated in FIG. 5, in the first wall body 21*f*F, a first support shaft 21*d*F (support shaft) is provided at a portion near the third wall body 21*h*. The first support shaft 21*d*F extends in the Y2 direction (first direction) from the surface in the Y2 direction of the first wall body 21*f*F. A tip part in the extending direction of the first support shaft 21*d*F is connected to the third wall body 21*h* via a first support unit 21*g*F extending in the X1 direction toward the third wall body 21*h*.

A first protrusion 21*c*F (protrusion) protrudes toward the X1 direction (second direction) on the surface on the X1 direction side of the first support shaft 21*d*F. The first protrusion 21*c*F extends to penetrate a gap between the first wall body 21*f*F and the third wall body 21*h*. The first protrusion 21*c*F connects the first wall body 21*f*F and the third wall body 21*h* to each other.

Figure 6:
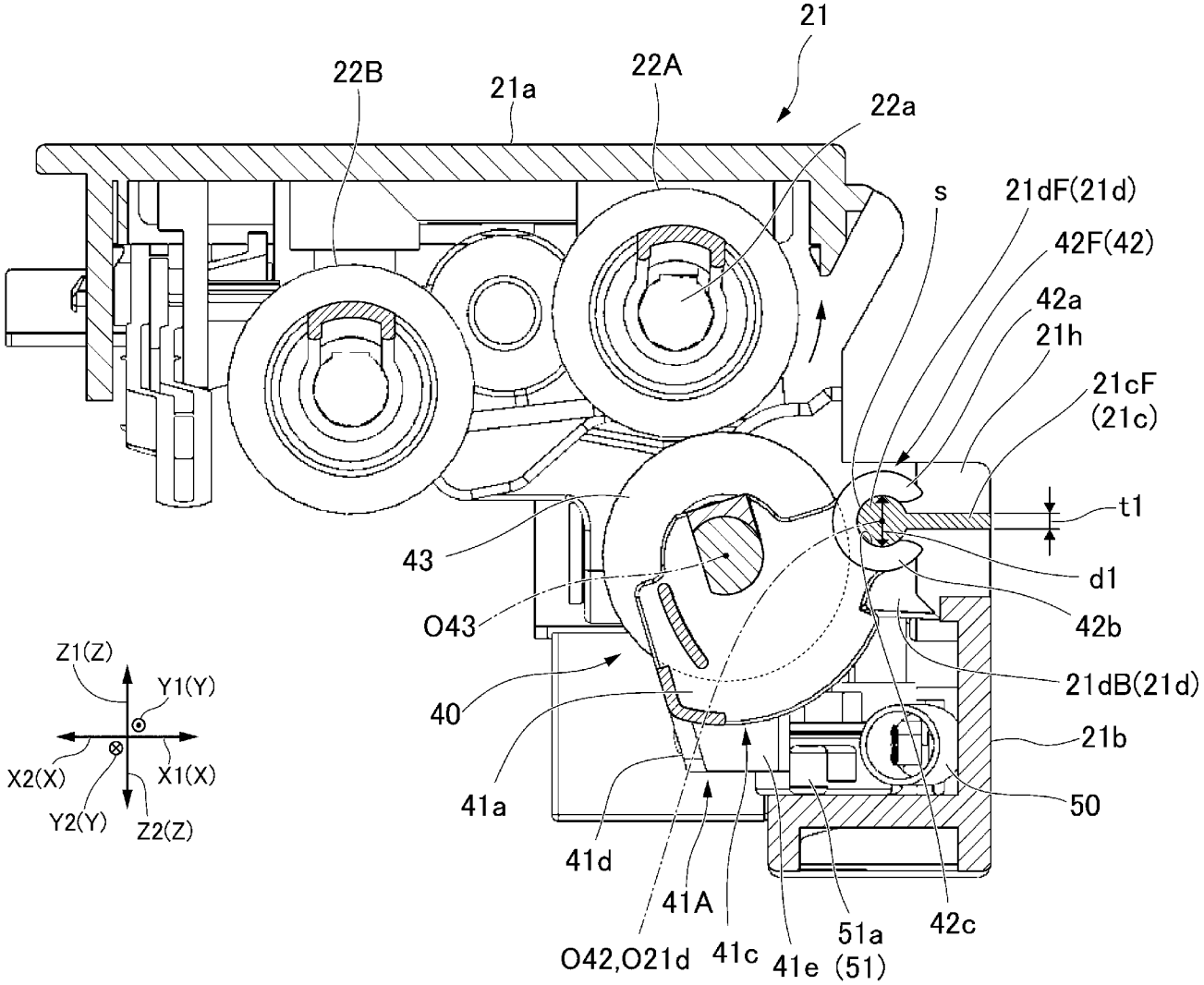
FIG. 6 is a schematic diagram of a cross section taken along the line A-A of FIG. 2.

As illustrated in a cross section of FIG. 6, the first support shaft 21*d*F is a cylinder having a diameter d1. The first protrusion 21*c*F is a flat plate that is parallel to the XY plane and has a thickness t1 when viewed from the Y direction. However, t1 is smaller than d1. An outer peripheral surface s excluding the first protrusion 21*c*F in the first support shaft 21*d*F is formed of a cylindrical surface forming a cylindrical surface having the diameter d1.

A shape of the first protrusion 21*c*F is not particularly limited as long as t1<d1 is satisfied and the first protrusion 21*c*F is not broken by an external force acting on the first protrusion 21*c*F by an attaching and detaching operation which will be described later.

As illustrated in FIG. 4, in the second wall body 21*f*B, a second support shaft 21*d*B (support shaft) is provided at a portion near the third wall body 21*h*. The second support shaft 21*d*B extends toward the Y1 direction (first direction) from the surface in the Y1 direction of the second wall body 21*f*B. A tip part in the extending direction of the second support shaft 21*d*B is connected to the third wall body 21*h* via a second support unit 21*g*B extending in the X1 direction toward the third wall body 21*h*.

A second protrusion 21*c*B (protrusion) protrudes toward the X1 direction (second direction) on the surface on the X1 direction side of the second support shaft 21*d*B. The second protrusion 21*c*B extends to penetrate a gap between the second wall body 21*f*B and the third wall body 21*h*. The second protrusion 21*c*B connects the second wall body 21*f*B and the third wall body 21*h* to each other.

The second support shaft 21*d*B, the second protrusion 21*c*B, and the second support unit 21*g*B have shapes that are plane-symmetric to the first support shaft 21*d*F, the first protrusion 21*c*F, and the first support unit 21*g*F with respect to a plane parallel to the ZX plane that bisects a distance between the first wall body 21*f*F and the second wall body 21*f*B.

Therefore, the second support shaft 21*d*B is disposed coaxially with the first support shaft 21*d*F. Although the cross section is not particularly illustrated, the diameter of the second support shaft 21*d*B and the thickness of the second protrusion 21*c*B are d1 and t1 in the same manner as those of the first support shaft 21*d*F and the first protrusion 21*c*F.

Hereinafter, the first support shaft 21*d*F and the second support shaft 21*d*B may be simply referred to as a support shaft 21*d*, and the first protrusion 21*c*F and the second protrusion 21*c*B may be simply referred to as a protrusion 21*c*.

As illustrated in FIG. 4, inclined surfaces 21*i* are respectively formed on both sides of the separation roller unit housing unit 21A in the Y direction at an upper part of the stay 21*b*. Each inclined surface 21*i* is a plane extending in an oblique direction toward the Z1 direction as advancing in the X1 direction.

On each inclined surface 21*i*, a conveyance guide 21*j* for guiding the conveyance of the sheet S which is not illustrated from below is provided.

The stay 21*b* described above may be formed by resin molding.

A pressurizing lever 51 and a coil spring 50 (spring) are disposed on a bottom surface part 21*e* of the stay 21*b*.

The pressurizing lever 51 includes a pressurizing arm 51*a*, a rotating shaft unit 51*b*, and a locking unit 51*c*.

The pressurizing arm 51*a* applies an energizing force in the X2 direction to the separation roller unit 40 which will be described later.

The rotating shaft unit 51*b* supports the pressurizing arm 51*a* to be swingable along the bottom surface part 21*e*. When a hole part is provided in the bottom surface part 21*e*, the rotating shaft unit 51*b* may be configured with a shaft unit that is rotatably fitted to the hole part. When a shaft shaped protrusion is provided on the bottom surface part 21*e*, the rotating shaft unit 51*b* may be configured with a hole part that is rotatably fitted to the shaft shaped protrusion.

The locking unit 51*c* locks the coil spring 50 which will be described later. For example, the locking unit 51*c* may be configured with a protrusion protruding in the X1 direction from the vicinity of the rotating shaft unit 51*b*.

The coil spring 50 is formed of a tension coil spring. At both end parts of the coil spring 50, hooks 50*a* and 50*b* are formed.

The hook 50*a* is locked to a tensioner 52 that is movably fixed in the Y direction at the end part in the Y1 direction of the stay 21*b*.

The hook 50*b* is locked to the locking unit 51*c* of the pressurizing lever 51.

The tensioner 52 is fixed to the stay 21*b* at a position where the coil spring 50 extends longer than a natural length. Therefore, a moment of force by an elastic restoring force generated in the coil spring 50 acts on the pressurizing lever 51 in the clockwise direction centering on the rotating shaft unit 51*b* when viewed from the Z2 direction.

An energizing force acting on the pressurizing lever 51 from the coil spring 50 is set in response to a required pressing force from the separation roller 43 which will be described later to the sheet feeding roller 22A.

Next, the separation roller unit 40 will be described.

Figure 7:
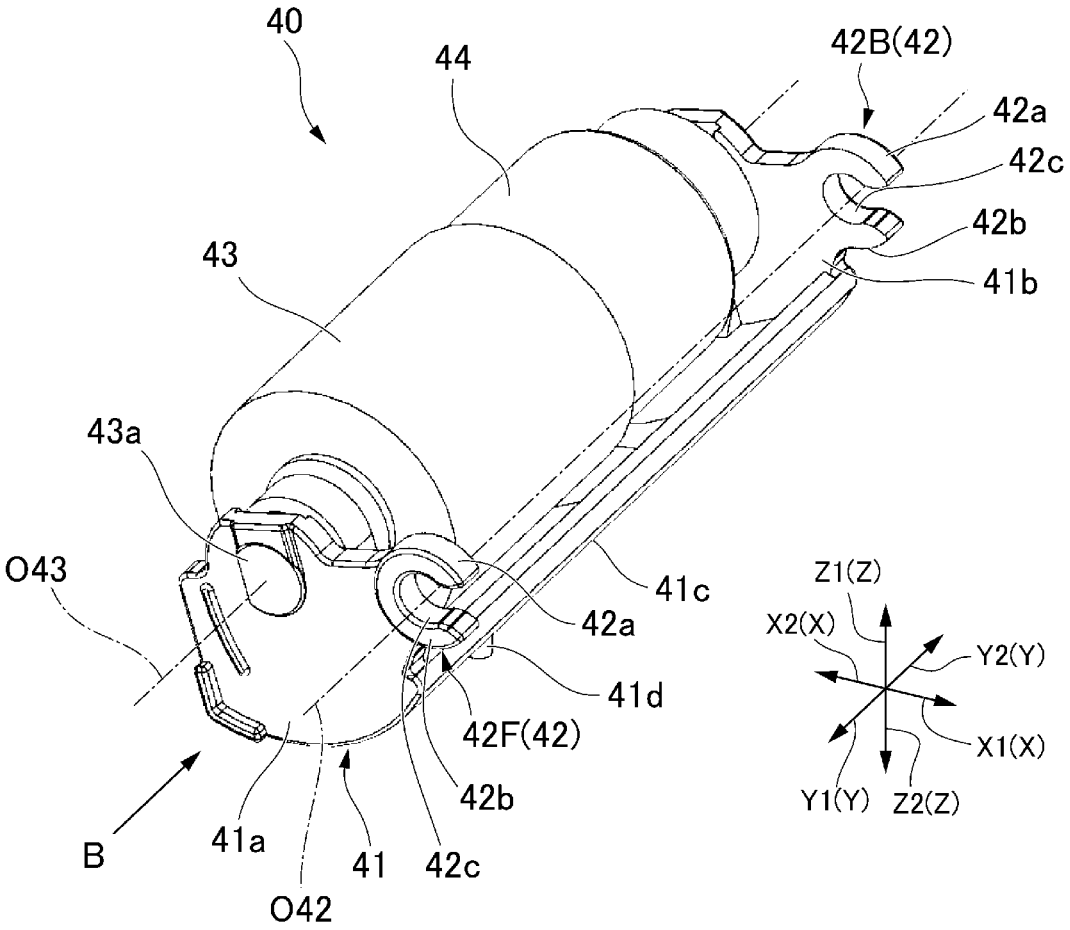
FIG. 7 is a schematic perspective view illustrating an example of a detachable member of the cassette sheet feeding unit.
Figure 8:
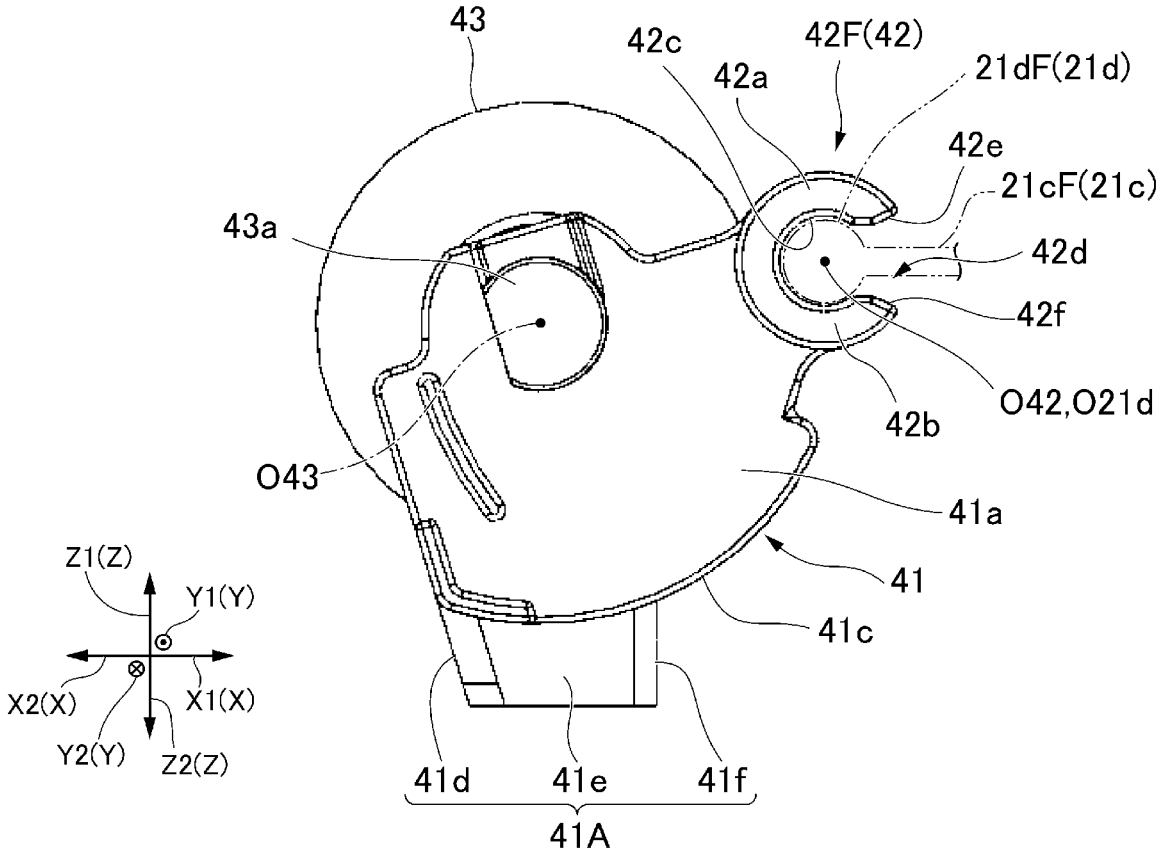
FIG. 8 is a schematic diagram when viewed from B (side view) in FIG. 7.

FIG. 7 is a schematic perspective view illustrating an example of the detachable member of the cassette sheet feeding unit in the image forming apparatus of the embodiment. FIG. 8 is a schematic diagram when viewed from B (side view) in FIG. 7.

As illustrated in FIG. 7, the separation roller unit 40 includes a shaft 43*a*, the separation roller 43, a torque limiter 44, and a holder 41.

The shaft 43*a* coaxially supports the separation roller 43 and the torque limiter 44, which will be described later, on a center axis O43 thereof. The shaft 43*a* is fixed to the holder 41 which will be described later at both end parts thereof in the axial direction.

The separation roller 43 has an approximately cylindrical shape having an outer diameter larger than that of the shaft 43*a*. On an outer peripheral part of the separation roller 43, an elastic body layer such as an elastomer capable of generating a respectively necessary frictional force between the sheet S and the sheet feeding roller 22A is provided.

The torque limiter 44 sets a minimum drive torque required for the clockwise rotation when viewed from the Y2 direction with respect to the rotation drive of the separation roller 43 around the shaft 43*a*. In the example illustrated in FIG. 7, the torque limiter 44 is disposed on the Y2 direction side of the separation roller 43.

The minimum drive torque is smaller than the torque by the conveyance force from the sheet feeding roller 22A, and larger than the torque by the frictional force of the two sheets S interposed between the sheet feeding roller 22A and the separation roller 43.

A configuration of the torque limiter 44 is not particularly limited as long as the minimum drive torque as described above can be set.

The holder 41 includes a front side plate 41*a*, a rear side plate 41*b*, a cover 41*c*, a first connecting unit 42F (connecting member, first connecting member), and a second connecting unit 42B (connecting member, second connecting member).

The front side plate 41*a* is provided on a side part in the Y1 direction of the holder 41. The front side plate 41*a* fixes an end part in the Y1 direction of the shaft 43*a*.

The rear side plate 41*b* is provided on a side part in the Y2 direction of the holder 41. The rear side plate 41*b* fixes an end part in the Y2 direction of the shaft 43*a*.

The rear side plate 41*b* has a shape that is plane-symmetric to the front side plate 41*a* with respect to a plane parallel to the ZX plane that bisects a distance between the front side plate 41*a* and the rear side plate 41*b*.

The cover 41*c* is a curved plate covering a lower surface of the holder 41. The cover 41*c* connects lower end parts of the front side plate 41*a* and the rear side plate 41*b* to each other in the Y direction.

As illustrated in FIG. 3, a protrusion 41A protrudes on the lower side of the cover 41*c* corresponding to an intermediate part in the longitudinal direction of the separation roller 43.

As illustrated in FIG. 8, the protrusion 41A includes a protruding piece 41*d* and a locking protrusion 41*e*.

The protruding piece 41*d* is a piece shaped body that inclines in the X1 direction as advancing in the Z2 direction from an end part in the X2 direction of the cover 41*c*.

The locking protrusion 41*e* extends in a plate shape parallel to the ZX plane from a center part in the Y direction of the protruding piece 41*d* toward the X1 direction.

A tip part 41*f* in the X1 direction of the locking protrusion 41*e* is positioned between the shaft 43*a* and the first connecting unit 42F in the X direction.

The tip part 41*f* is provided at a position where the tip part 41*f* abuts on the pressurizing arm 51*a* in a mounting state of the separation roller unit 40. The tip part 41*f* transmits the moment by an energizing force from the pressurizing arm 51*a* to the separation roller unit 40.

As illustrated in FIG. 6, the first connecting unit 42F is provided at an end part on the X1 direction side of the front side plate 41*a*. A shape of the first connecting unit 42F is not particularly limited as long as the first connecting unit 42F can be connected to the first protrusion 21*c*F to interpose the first protrusion 21*c*F therebetween and surround an outer periphery of the first support shaft 21*d*F.

The first connecting unit 42F includes a first snap fit joint 42*a* and a second snap fit joint 42*b*. The first connecting unit 42F is formed of an elastic material.

As illustrated in FIG. 8, when viewed from the Y2 direction, a shape of the first snap fit joint 42*a* is a circular arc shape along an outer peripheral surface on the upper side of the first support shaft 21*d*F.

In the same manner, a shape of the second snap fit joint 42*b* is a circular arc shape along an outer peripheral surface on the lower side of the first support shaft 21*d*F.

Therefore, the first connecting unit 42F protrudes in a C shape from an end part of the front side plate 41*a* toward the X1 direction. An inner peripheral surface of the first connecting unit 42F is a smooth curved surface that covers an outer peripheral surface s of the first support shaft 21*d*F in a range of a center angle larger than 180 degrees. Specifically, a shape of an inner peripheral surface 42*c* of the first connecting unit 42F is a circular arc with a center axis O42 as a center when viewed from the Y2 direction. A radius of the inner peripheral surface 42*c* is about half of a diameter of the first support shaft 21*d*F.

An opening unit 42*d* (gap) is formed between a tip surface 42*e* in the circumferential direction of the curvature of the first snap fit joint 42*a* and a tip surface 42*f* in the circumferential direction of the curvature of the second snap fit joint 42*b*.

A width of the opening unit 42*d* when viewed from the Y direction is wider than a width (thickness) of the first protrusion 21*c*F in the circumferential direction and narrower than an outer diameter of the first support shaft 21*d*F.

Since the first connecting unit 42F is formed of an elastic material, when at least one of the first snap fit joint 42*a* and the second snap fit joint 42*b* is elastically deformed, the width of the opening unit 42*d* can be widened. When the width of the opening unit 42*d* is wider than the outer diameter of the first support shaft 21*d*F, the first connecting unit 42F can be attached to and detached from the first support shaft 21*d*F from the side opposite to the first protrusion 21*c*F.

Since the outer peripheral surface s of the first support shaft 21*d*F is a cylindrical surface that can be slidably fitted to the inner peripheral surface 42*c*, when the first connecting unit 42F is mounted on the first support shaft 21*d*F, the inner peripheral surface 42*c* is slidably fitted to the outer peripheral surface s. Here, since the inner diameter of the inner peripheral surface 42*c* and the outer diameter of the first support shaft 21*d*F are approximately equal (including a case where the inner diameter thereof and the outer diameter are equal), the center axis O42 of the first connecting unit 42F and a center axis O21*d* of the first support shaft 21*d*F are approximately coaxial (including a case of coaxial).

The first connecting unit 42F mounted on the first support shaft 21*d*F can swing around the center axis O21*d* within a range of a dimensional difference in the circumferential direction between the opening unit 42*d* and the first protrusion 21*c*F.

Shapes of the tip surfaces 42*e* and 42*f* and the opening unit 42*d* are not particularly limited as long as a swing range (hereinafter referred to as a minimum swing range) equal to or greater than a swing range required for the first connecting unit 42F is obtained.

The minimum swinging range of the first connecting unit 42F is a range in which an assembly error and a component error are included, the separation roller 43 held by the holder 41 can abut on the sheet feeding roller 22A, and one sheet S having the maximum thickness of the sheet S that can be fed can be interposed between the sheet feeding roller 22A and the separation roller 43.

However, the swing range of the first connecting unit 42F may be wider than the minimum swing range in consideration of easiness of attachment and detachment of the separation roller unit 40.

The minimum width of the opening unit 42*d* when viewed from the Y direction defines pull-out resistance when the first connecting unit 42F is pulled out from the first support shaft 21*d*F. It is more desirable that the pull-out resistance is as large as possible in a range that does not hinder the separation roller unit 40 from being attached or detached.

Figure 9:
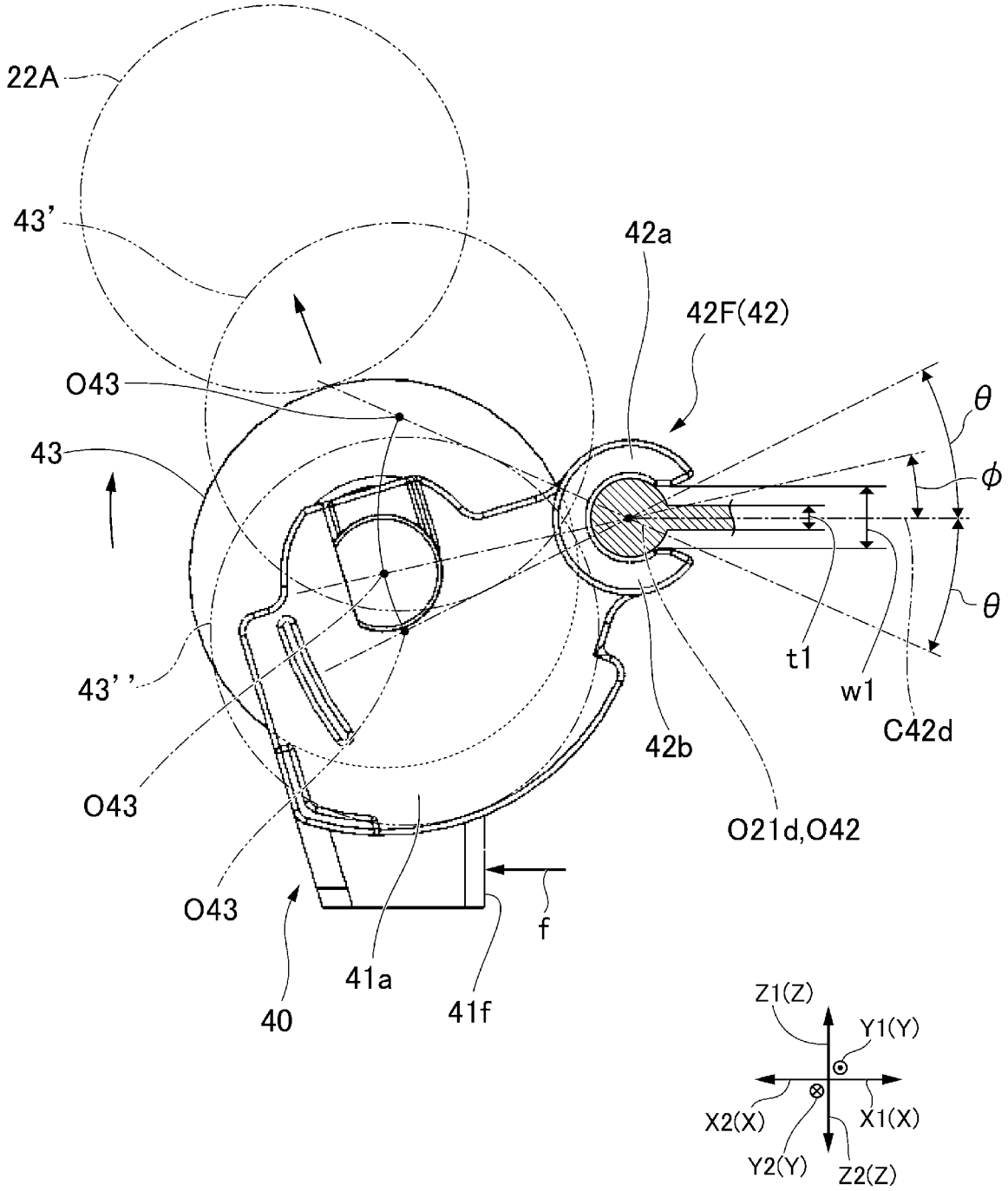
FIG. 9 is a schematic cross-sectional view illustrating a positional relationship between a connecting member and a support shaft in the cassette sheet feeding unit.

As illustrated in FIG. 9, the minimum width of the opening unit 42*d* when viewed from the Y direction may be w1. However, w1 is larger than t1 and smaller than d1.

It is more desirable that the opening unit 42*d* when viewed from the Y direction has such a shape that a distance from a center line C42*d* of the opening unit 42*d* gradually increases from the inside toward the outside in the radial direction of the first connecting unit 42F. For example, when viewed from the Y direction, the tip surfaces 42*e* and 42*f* may extend in the radial direction with respect to the center axis O42.

In the example illustrated in FIG. 9, the tip surfaces 42*e* and 42*f* are opposite to each other in parallel by being respectively separated from the center line C42*d* by w1/2 in the vicinity of the innermost part in the radial direction, and are inclined obliquely along the radial direction passing through the center axis O42 on the outer side in the radial direction.

Inclination angles of the tip surfaces 42*e* and 42*f* with respect to the center line C42*d* are respectively acute angles θ.

Such a first connecting unit 42F has a distance L between the center of the inner peripheral surface 42*c* and the center of the shaft 43*a*, and is provided at a position where the center line C42*d* rotates by an angle ϕ in the clockwise direction in the drawing with respect to a line segment connecting the center of the shaft 43*a* and the center of the inner peripheral surface 42*c*. Here, ϕ is an acute angle. That is, in a state where the first connecting unit 42F is mounted on the first support shaft 21*d*F, when viewed from the Y direction, the center line C42*d* of the opening unit 42*d* is inclined by ϕ in the Z2 direction with respect to a straight line connecting the center axis O21*d* which is the center of the first support shaft 21*d*F and the center axis O43 which is the center of the separation roller 43.

Here, the sizes of L and ϕ are appropriately set in response to the size of the separation roller unit housing unit 21A. For example, L may be a distance slightly longer than a radius of the separation roller 43. For example, ϕ may be an angle orthogonal to the opposite direction to the sheet feeding roller 22A and the separation roller 43.

The first connecting unit 42F is described above, and the second connecting unit 42B has a shape that is plane-symmetric to the first connecting unit 42F with respect to a plane parallel to the ZX plane that bisects the distance between the front side plate 41*a* and the rear side plate 41*b*. That is, the second connecting unit 42B includes the first snap fit joint 42*a* and the second snap fit joint 42*b* that correspond to the first snap fit joint 42*a* and the second snap fit joint 42*b* of the first connecting unit 42F, and are plane-symmetrical to each other.

Therefore, detailed description of each unit of the second connecting unit 42B will be omitted.

Hereinafter, the first connecting unit 42F and the second connecting unit 42B may be simply referred to as a connecting unit 42.

The holder 41 having such a configuration may be formed of, for example, a resin molded product. However, the holder 41 may have a composite structure of a plurality of members. For example, each connecting unit 42 may be a separate member as long as each connecting unit 42 is fixed to the front side plate 41*a* and the rear side plate 41*b*.

In the separation roller unit 40, each connecting unit 42 is connected to each support shaft 21*d* from the X2 direction side of each support shaft 21*d*. At the time of such mounting, the separation roller unit 40 can swing in the ZX plane centering on the center axis O21*d*. As illustrated in FIG. 9, the separation roller 43 can be moved to positions such as separation rollers 43' and 43" indicated by two-dot chain line by swinging of the separation roller unit 40.

In the mounted state, a pressurizing force f acts on the tip part 41*f* in the X2 direction from the pressurizing arm 51*a* which is not illustrated. Therefore, the separation roller unit 40 receives the moment of a force in the clockwise direction centering on the center axis O21*d* when viewed from the Y2 direction. As a result, when the sheet S which is not illustrated is not fed, the separation roller 43 presses the sheet feeding roller 22A from below. Accordingly, the nip part is formed between the separation roller 43 and the sheet feeding roller 22A.

The pressing force from the separation roller 43 to the sheet feeding roller 22A and the energizing force of the coil spring 50 (not illustrated) corresponding thereto are predetermined so that the nip width becomes an appropriate value.

Next, a detailed configuration of the manual sheet feeding unit 11 will be described.

Figure 10:
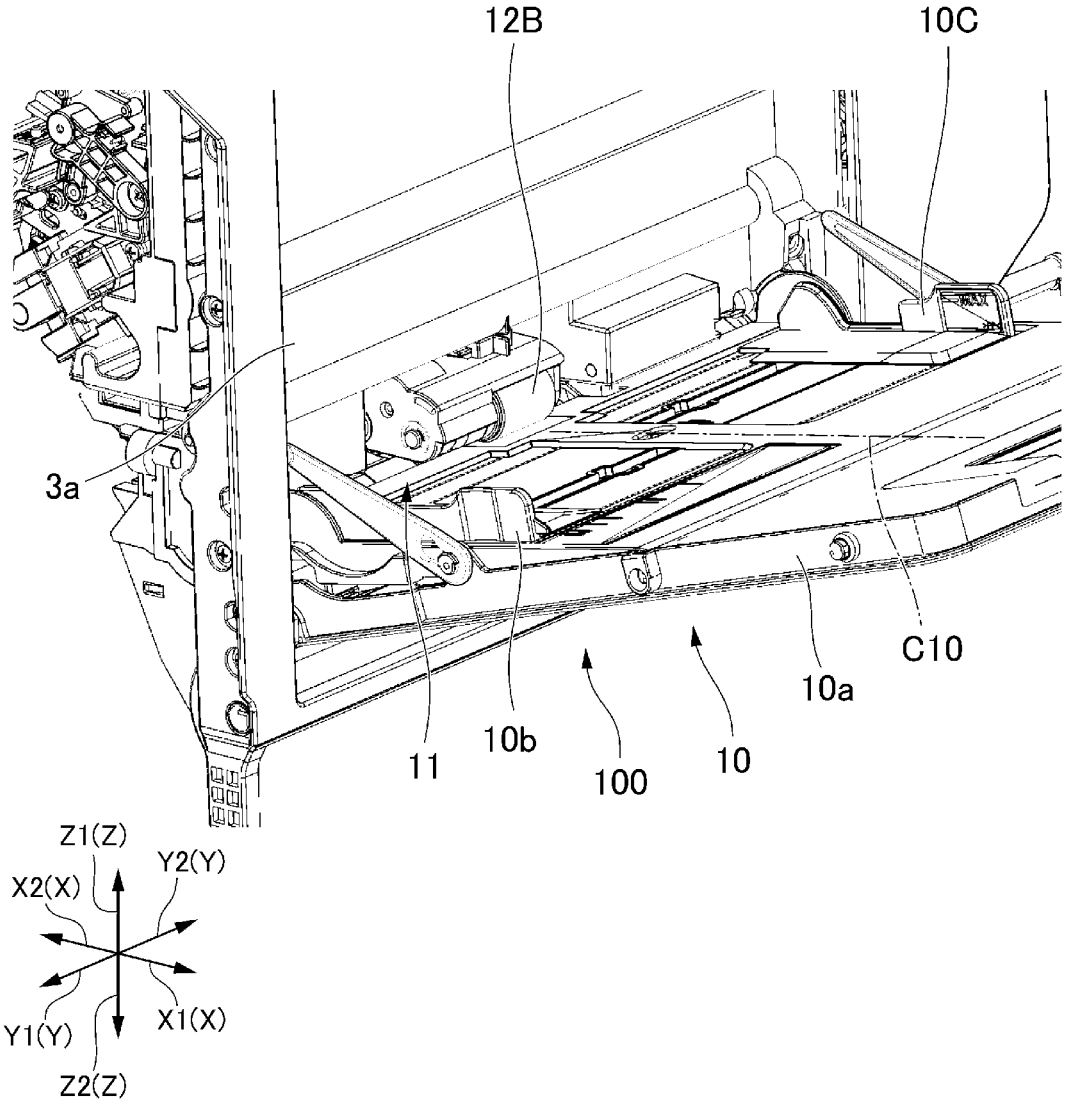
FIG. 10 is a schematic perspective view illustrating an example of a manual sheet feeding unit (sheet feeding unit) of the apparatus.
Figure 11:
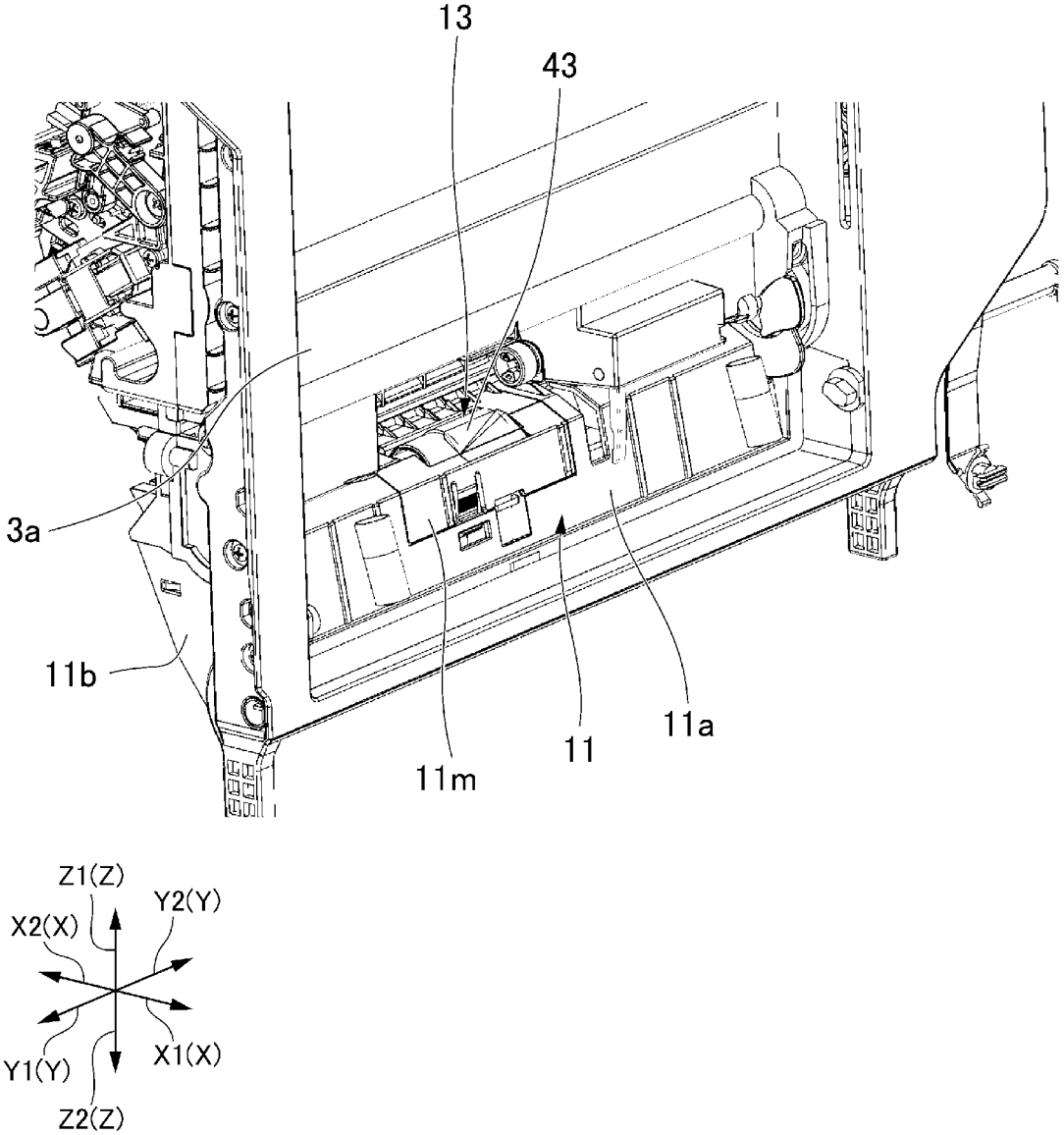
FIG. 11 is a schematic perspective view illustrating a main part of the manual sheet feeding unit.
Figure 12:
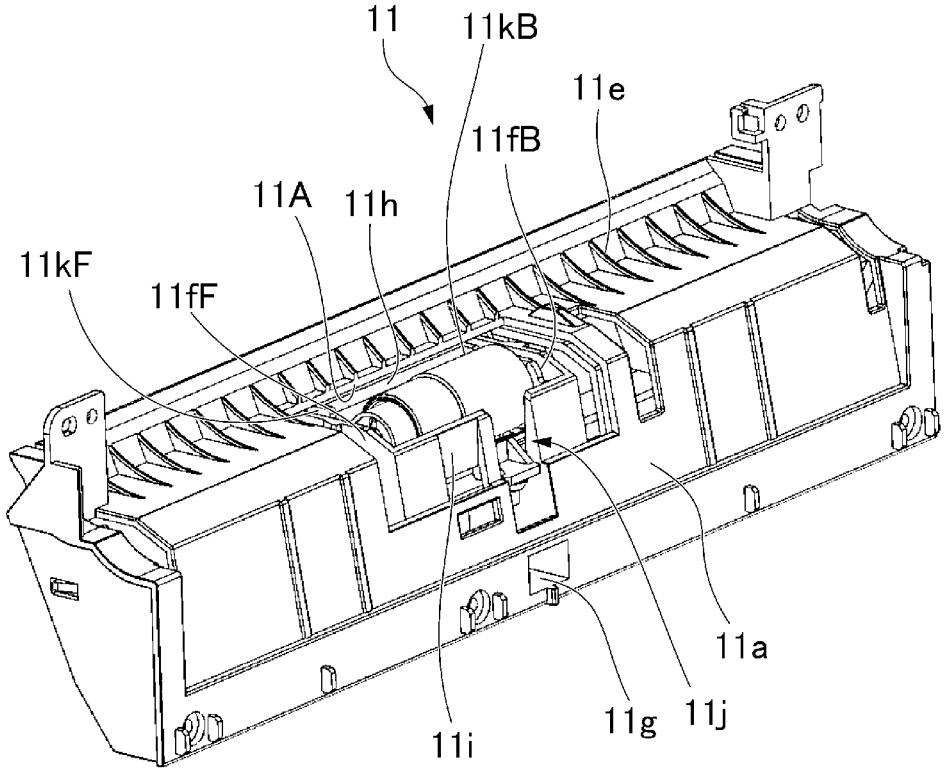
FIG. 12 is a schematic perspective view of the manual sheet feeding unit.
Figure 12:
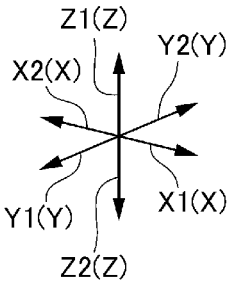
Figure 13:
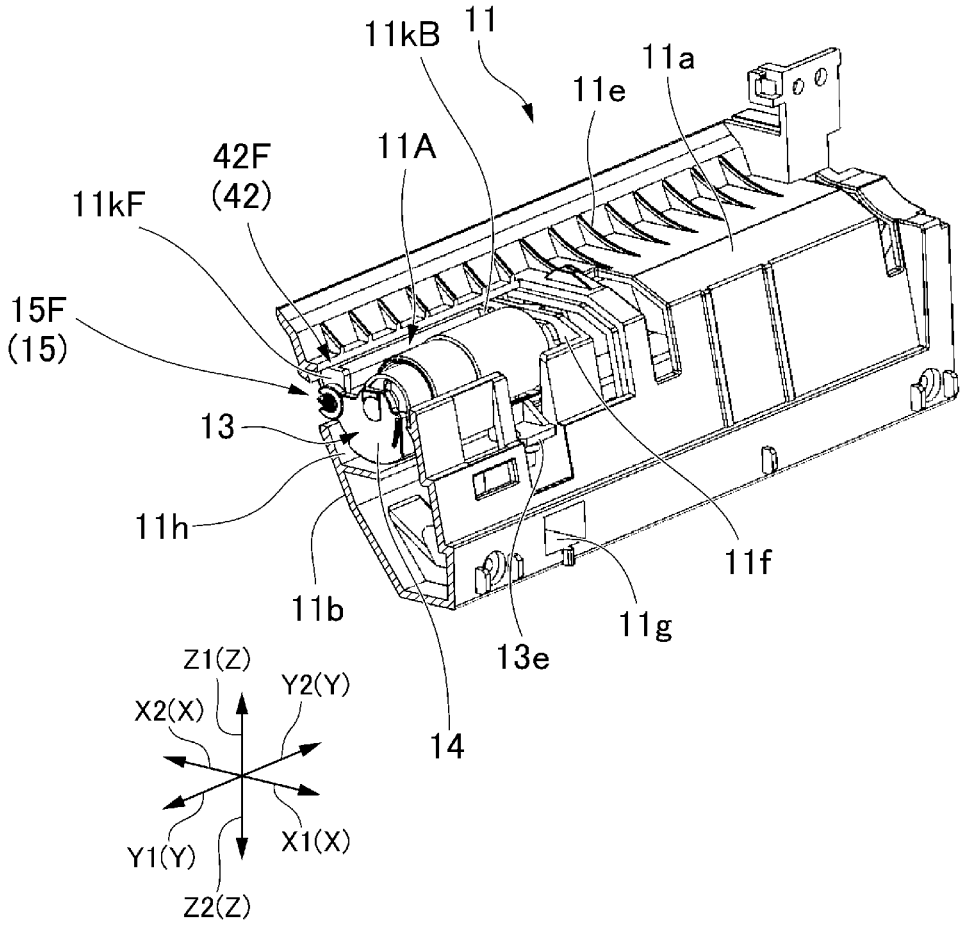
FIG. 13 is a schematic perspective view in which the manual sheet feeding unit is partially broken.
Figure 14A:
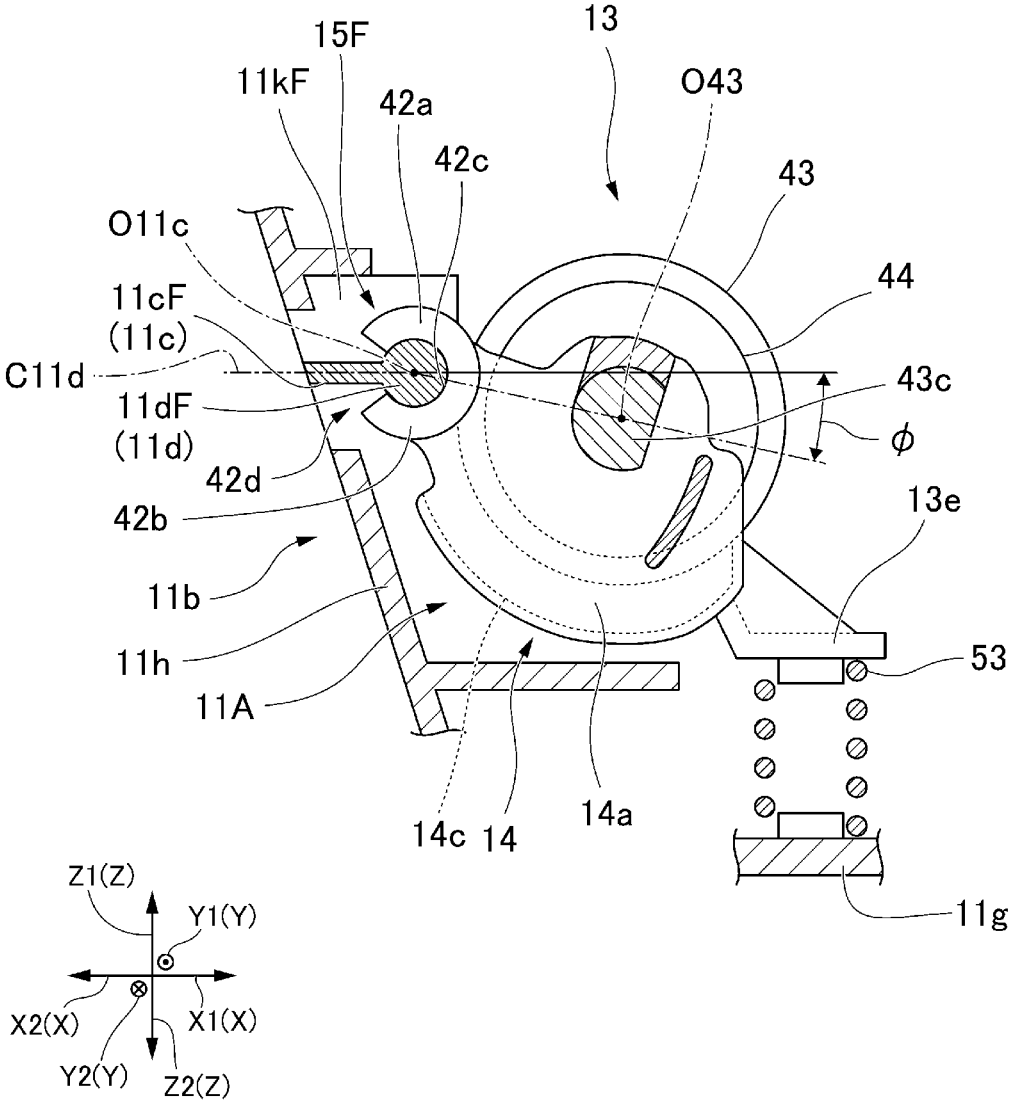
FIG. 14A is a schematic cross-sectional view illustrating an example of a detachable member of the manual sheet feeding unit.
Figure 14B:
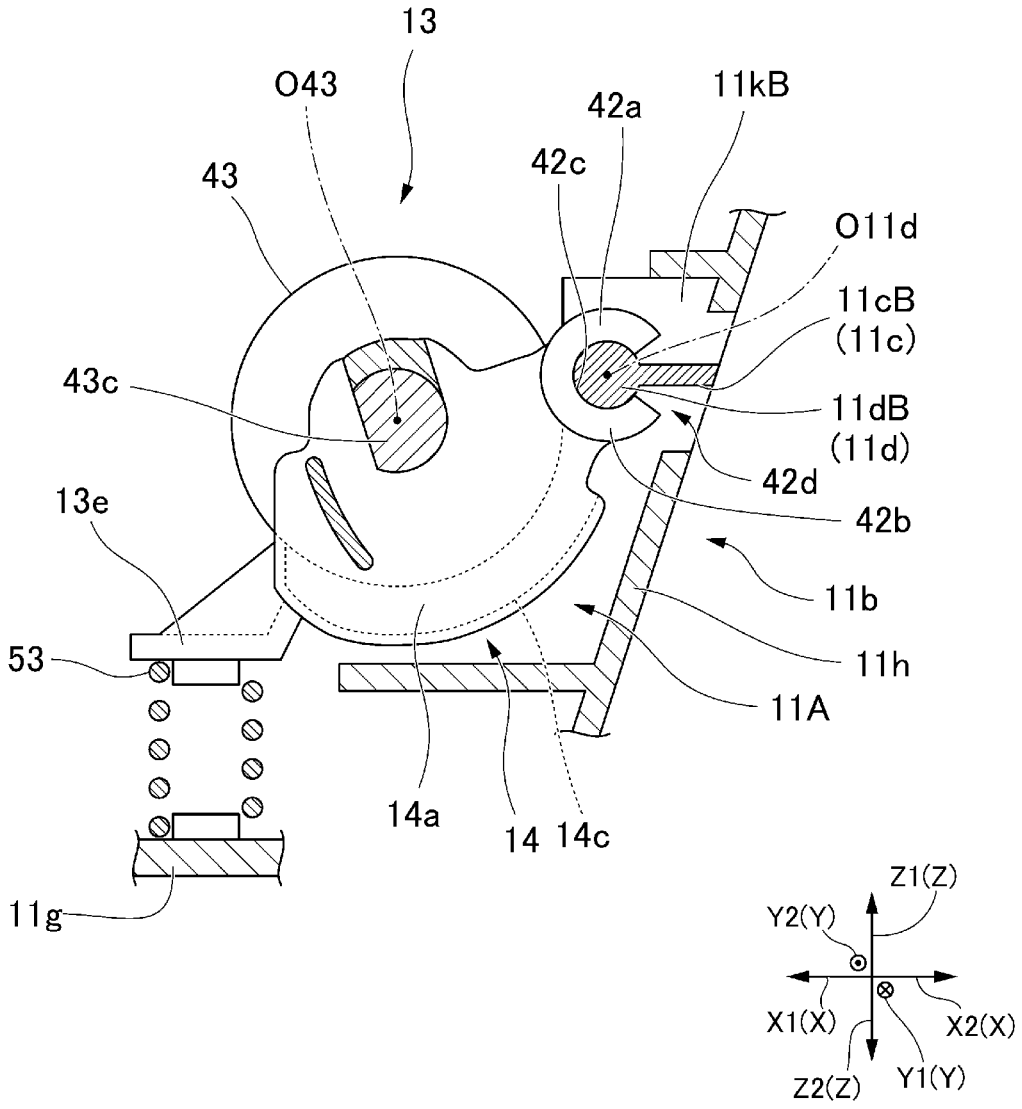
FIG. 14B is a schematic cross-sectional view illustrating an example of the detachable member of the manual sheet feeding unit.

FIG. 10 is a schematic perspective view illustrating an example of the manual sheet feeding unit (sheet feeding unit) in the image forming apparatus of the embodiment. FIG. 11 is a schematic perspective view illustrating a main part of the manual sheet feeding unit in the image forming apparatus of the embodiment. FIG. 12 is a schematic perspective view of the manual sheet feeding unit in the image forming apparatus of the embodiment. FIG. 13 is a schematic perspective view in which the manual sheet feeding unit is partially broken in the image forming apparatus of the embodiment. FIGS. 14A and 14B are schematic cross-sectional views illustrating an example of a detachable member of the manual sheet feeding unit in the image forming apparatus of the embodiment.

FIG. 10 illustrates a state where the manual feeding tray 10*a* is opened. On the upper surface of the manual feeding tray 10*a*, guide plates 10*b* and 10*c* for guiding both end parts of the sheet P which is not illustrated in the Y direction are provided. The guide plates 10*b* and 10*c* can move in line symmetry with each other with a conveyance center line C10 that bisects a distance therebetween in the Y direction as a symmetric axis.

The manual sheet feeding unit 11 is provided in the vicinity of a tip part in the X2 direction of the manual feeding tray 10*a*. The pickup roller 12B, the sheet feeding roller 12A (not illustrated), and the separation roller 43 (not illustrated) of the manual sheet feeding unit 11 are positioned on the conveyance center line C10 when viewed from the Z direction.

As illustrated in FIG. 11, in a state where an inner cover 11*a* and the manual sheet feeding roller unit 12 are removed, the separation roller unit 13 (detachable member) including the separation roller 43 is exposed below an opening unit 3*b* formed at a lower end part of a side cover 3*a*.

The separation roller unit 13 is fixed to a stay 11*b* disposed inside the printer unit 3. The stay 11*b* is covered by the inner cover 11*a* disposed below the side cover 3*a* from the X1 direction. The stay 11*b* is fixed between a front side plate and a rear side plate of the printer unit 3 which are not illustrated.

A lid 11*m* that covers the X1 direction side of the separation roller unit 13 is detachably provided below the opening unit 3*b* in the inner cover 11*a*.

As illustrated in FIG. 12, a sheet feeding guide 11*e* that feeds the sheet P which is not illustrated toward a registration roller 24 which is not illustrated is formed on an upper part of the stay 11*b* over the whole Y direction.

A separation roller unit housing unit 11A (detachable member housing unit) is formed at a center part in the longitudinal direction (Y direction) of the stay 11*b*. The separation roller unit housing unit 11A detachably houses the separation roller unit 13.

The separation roller unit housing unit 11A is a recessed part surrounding the separation roller unit 13 when viewed in the Z2 direction.

The separation roller unit housing unit 11A is formed to be surrounded by a first wall body 11*f*F, a second wall body 11*f*B, a third wall body 11*h*, and a fourth wall body 11*i*.

The first wall body 11*f*F and the second wall body 11*f*B are flat plate units parallel to the ZX plane. The first wall body 11*f*F and the second wall body 11*f*B have the same outer shape when viewed from the Y direction. The first wall body 11*f*F and the second wall body 11*f*B are opposite to each other in the Y direction. The first wall body 11*f*F is disposed on the Y1 direction side of the separation roller unit housing unit 11A. The second wall body 11*f*B is disposed on the Y2 direction side of the separation roller unit housing unit 11A.

As illustrated in FIGS. 13 and 14A, the third wall body 11*h* is a flat plate unit which inclines in the X2 direction as advancing to the Z1 direction.

As illustrated in FIG. 12, the third wall body 11*h* is disposed to be interposed between respective end parts of the X2 direction side of the first wall body 11*f*F and the second wall body 11*f*B.

Both end parts in the Y direction of the third wall body 11*h* are respectively joined to the first wall body 11*f*F and the second wall body 11*f*B.

At an upper part of the third wall body 11*h*, a first shaft support plate 11*k*F formed of a flat plate parallel to the ZX plane protrudes in the X1 direction closer to the Y2 direction than the first wall body 11*f*F.

At the upper part of the third wall body 11*h*, a second shaft support plate 11*k*B formed of a flat plate parallel to the ZX plane protrudes in the X1 direction closer to the Y1 direction than the second wall body 11*f*B.

The fourth wall body 11*i* is disposed to be interposed between respective end parts on the X1 direction side of the first wall body 11*f*F and the second wall body 11*f*B.

Both end parts in the Y direction of the fourth wall body 11*i* are respectively joined to the first wall body 11*f*F and the second wall body 11*f*B.

An opening unit 11*j* penetrating the fourth wall body 11*i* in the Z direction is formed in an intermediate part near the second wall body 11*f*B in the Y direction of the fourth wall body 11*i*.

In the stay 11*b*, a plate shaped unit 11*g* parallel to the XY plane is provided below the opening unit 11*j* (Z2 direction side).

As illustrated in FIG. 14A, a first support shaft 11*d*F (support shaft) and a first protrusion 11*c*F (protrusion) are provided between the first shaft support plate 11*k*F and the first wall body 11*f*F (not illustrated).

The first support shaft 11*d*F and the first protrusion 11*c*F are the same members as the first support shaft 21*d*F and the first protrusion 21*c*F in the cassette sheet feeding unit 21, except that the first support shaft 11*d*F and the first protrusion 11*c*F are provided between the first shaft support plate 11*k*F and the first wall body 11*f*F.

For example, an outer diameter of the first support shaft 11*d*F is d1 and a thickness in the Z direction of the first protrusion 11*c*F is t1.

However, the first support shaft 11*d*F is disposed away in the X1 direction further than the third wall body 11*h*. The first protrusion 11*c*F extends in the X2 direction from the side surface on the X2 direction side of the first support shaft 11*d*F.

As illustrated in FIG. 14B, a second support shaft 11*d*B (support shaft) and a second protrusion 11*c*B (protrusion) are provided between the second shaft support plate 11*k*B and the second wall body 11*f*B (not illustrated).

The second support shaft 11*d*B and the second protrusion 11*c*B are the same members as the second support shaft 21*d*B and the second protrusion 21*c*B in the cassette sheet feeding unit 21, except that the second support shaft 11*d*B and the second protrusion 11*c*B are provided between the second shaft support plate 11*k*B and the second wall body 11*f*B.

The second support shaft 11*d*B, the second protrusion 11*c*B, and the second shaft support plate 11*k*B have a shape that is plane-symmetric to the first support shaft 11*d*F, the first protrusion 11*c*F, and the first shaft support plate 11*k*F, with respect to a plane parallel to the ZX plane that bisects a distance between the first wall body 11*f*F and the second wall body 11*f*B.

Therefore, the second support shaft 11*d*B is disposed coaxially with the first support shaft 11*d*F. That is, the center axes of the first support shaft 11*d*F and the second support shaft 11*d*B are aligned on a center axis O11*d* extending in the Y direction.

A diameter of the second support shaft 11*d*B and a thickness in the Z direction of the second protrusion 11*c*B are d1 and t1 in the same manner as those of the first support shaft 11*d*F and the first protrusion 11*c*F.

Hereinafter, the first support shaft 11*d*F and the second support shaft 11*d*B may be simply referred to as a support shaft 11*d*, and the first protrusion 11*c*F and the second protrusion 11*c*B may be simply referred to as a protrusion 11*c*.

As illustrated in FIG. 13, the separation roller unit 13 includes a holder 14 instead of the holder 41 of the separation roller unit 40.

Hereinafter, a detailed configuration of the separation roller unit 13 will be mainly described about a point different from the separation roller unit 40.

The separation roller 43 and the torque limiter 44 in the separation roller unit 13 have the same configuration as that of the separation roller 43 and the torque limiter 44 in the separation roller unit 40 except that the separation roller 43 and the torque limiter 44 in the separation roller unit 13 are disposed in this order in the Y1 direction.

As illustrated in FIGS. 14A and 14B, instead of the front side plate 41*a*, the rear side plate 41*b*, the cover 41*c*, the first connecting unit 42F, the second connecting unit 42B, and the protrusion 41A in the holder 41, the holder 14 includes a front side plate 14*a* (refer to FIG. 14A), a rear side plate 14*b* (refer to FIG. 14B), a cover 14*c*, a first connecting unit 15F (connecting member, first connecting member, refer to FIG. 14A), and a second connecting unit 15B (connecting member, second connecting member, refer to FIG. 14B), and a spring locking unit 13*e*.

The front side plate 14*a* is provided on the side part in the Y1 direction of the holder 14. The front side plate 14*a* fixes an end part in the Y1 direction of the shaft 43*a*.

The rear side plate 14*b* is provided on the side part in the Y2 direction of the holder 14. The rear side plate 14*b* fixes an end part in the Y2 direction of the shaft 43*a*.

The rear side plate 14*b* has a shape that is plane-symmetric to the front side plate 14*a* with respect to a plane parallel to the ZX plane that bisects a distance between the front side plate 14*a* and the rear side plate 14*b*.

The cover 14*c* is formed of a curved plate covering a lower surface of the holder 14. The cover 14*c* connects lower end parts of the front side plate 14*a* and the rear side plate 14*b* to each other in the Y direction.

As illustrated in FIG. 14A, the first connecting unit 15F is provided at an end part on the X2 direction side of the front side plate 14*a*. The first connecting unit 15F includes the first snap fit joint 42*a* and the second snap fit joint 42*b* in the same manner as that of the first connecting unit 42F. However, the opening unit 42*d* between the first snap fit joint 42*a* and the second snap fit joint 42*b* in the first connecting unit 15F faces the X2 direction.

As illustrated in FIG. 14B, the second connecting unit 15B is provided at an end part on the X2 direction side of the rear side plate 14*b*. The second connecting unit 15B includes the first snap fit joint 42*a* and the second snap fit joint 42*b* in the same manner as that of the second connecting unit 42B. However, the opening unit 42*d* between the first snap fit joint 42*a* and the second snap fit joint 42*b* in the second connecting unit 15B faces the X2 direction.

The first connecting unit 15F and the second connecting unit 15B are formed of an elastic material.

The spring locking unit 13*e* includes a plate shaped unit that locks an upper end part of a coil spring 53 (spring) locked to an upper surface of the plate shaped unit 11*g* from above. The spring locking unit 13*e* is connected to an end part in the X1 direction of the cover 1*c*.

As illustrated in FIG. 13, the spring locking unit 13*e* is provided at a position where the spring locking unit 13*e* corresponds to an intermediate part in the longitudinal direction of the separation roller 43 in the Y direction. However, in FIG. 13, the illustration of the coil spring 53 is omitted (the same also applies to FIG. 12).

The coil spring 53 energizes the spring locking unit 13*e* in the Z1 direction when the separation roller unit 13 is mounted on the manual sheet feeding unit 11. A compression coil spring is used for the coil spring 53. A natural length of the coil spring 53 is longer than a distance from a lower surface of the spring locking unit 13*e* to a surface of the plate shaped unit 11*g* when the separation roller 43 and the sheet feeding roller 12A abut on each other.

An energizing force of the coil spring 53 generated when the coil spring 53 is mounted between the plate shaped unit 11*g* and the spring locking unit 13*e* is predetermined so that a nip width between the separation roller 43 and the sheet feeding roller 12A becomes an appropriate value.

The holder 14 having such a configuration may be formed of a resin molded product in the same manner as that of the holder 41, or may be formed by combining a plurality of members.

The separation roller unit 13 is mounted in the same manner as that of the separation roller unit 40, except a point where each connecting unit 15 is connected to each support shaft 11*d* from the X1 direction side of each support shaft 11*d* and a point where each connecting unit 15 is energized toward the sheet feeding roller 12A by the coil spring 53. At the time of mounting, the separation roller unit 13 can swing in the ZX plane centering on the center axis O11*d*.

Next, an operation of the image forming apparatus 100 will be mainly described about an attaching and detaching operation of the separation roller units 40 and 13.

First, an image forming operation of the image forming apparatus 100 will be briefly described.

In the image forming apparatus 100 illustrated in FIG. 1, image formation is started by an operation of the control panel 1 or an external signal. The image information is sent to the printer unit 3 after a target to be copied is read by the scanner unit 2, or sent to the printer unit 3 from the outside. The printer unit 3 supplies the sheet S in the sheet supply unit 4 or the sheet P in the manual feeding unit 10 to the registration roller 24 based upon a control signal generated by the main body control unit 6 based upon the operation of the control panel 1 or the external signal. Hereinafter, as an example, a case where the sheet S is supplied will be described.

When an operation input of the image formation is performed from the control panel 1, the main body control unit 6 performs control for starting sheet feeding from the sheet supply unit 4 and the image formation.

The image forming units 25Y, 25M, 25C, and 25K form an electrostatic latent image on each photosensitive drum 7 based upon image information corresponding to a color. Each electrostatic latent image is respectively developed by the developing device 8. Therefore, a toner image corresponding to the electrostatic latent image is formed on the surface of each photosensitive drum 7.

Each toner image is primarily transferred to the intermediate transfer belt 27 by each transfer roller. As the intermediate transfer belt 27 moves, the respective toner images are sequentially superimposed without causing color shift, and then sent to the transfer unit 28.

The sheet S is fed from the registration roller 24 to the transfer unit 28. The toner image reaching the transfer unit 28 is secondarily transferred to the sheet S. The secondarily transferred toner image is fixed on the sheet S by the fixing device 29. Thus, an image is formed on the sheet S.

When such image formation is repeated, each separation roller 43 is worn by friction at the time of the separation operation. When the wear in each separation roller 43 exceeds an allowable limit, the separation performance deteriorates. Therefore, each separation roller 43 is replaced as necessary.

In the embodiment, the separation roller 43 of the cassette sheet feeding unit 21 is replaced for each separation roller unit 40, and the separation roller 43 of the manual sheet feeding unit 11 is replaced for each separation roller unit 13 as follows.

First, a method of replacing the separation roller unit 40 will be described.

Figure 15A:
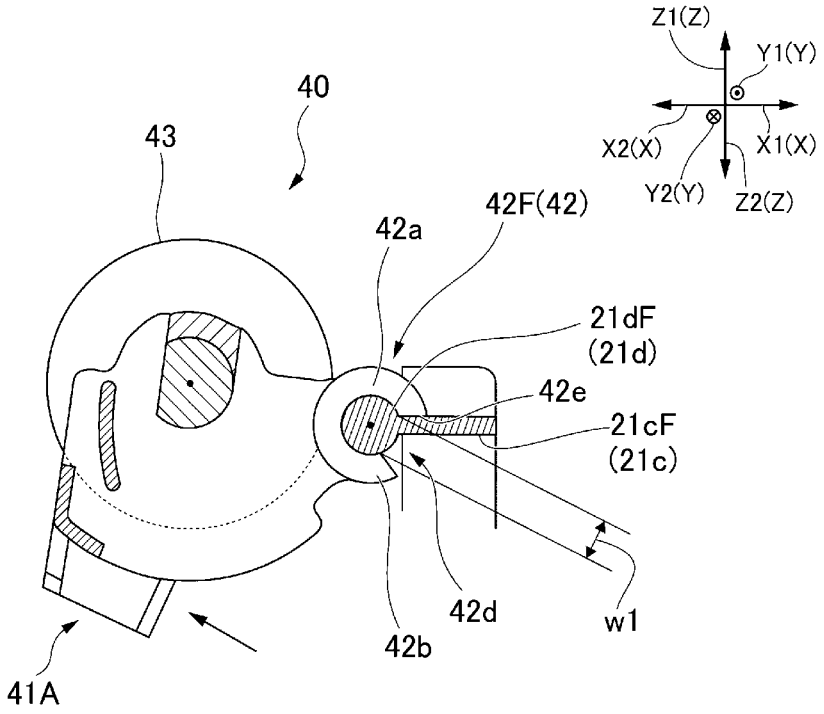
FIGS. 15A and 15B are schematic cross-sectional views illustrating a removal operation of the connecting member in the cassette sheet feeding unit.
Figure 15B:
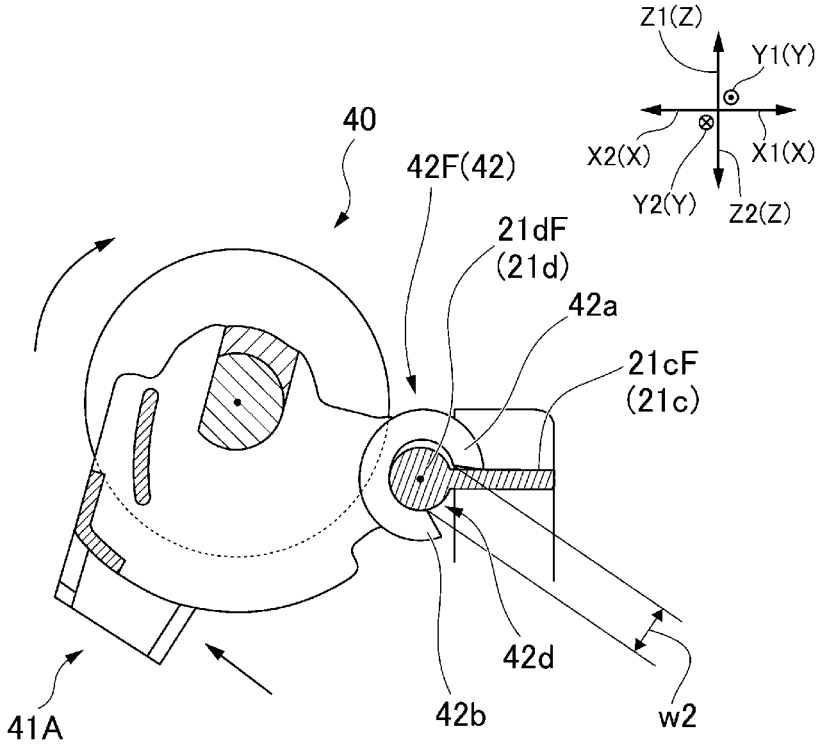

FIGS. 15A and 15B are schematic cross-sectional views illustrating a removal operation of the connecting member in the cassette sheet feeding unit in the image forming apparatus of the embodiment.

An exchanger first removes the sheet feeding roller 22A so that the separation roller unit 40 can rotate upward.

Thereafter, as illustrated in FIG. 15A, the exchanger rotates the separation roller unit 40 in the clockwise direction in the drawing around each support shaft 21*d* up to an upper swing limit. Here, the exchanger, for example, holds a part of the holder 14 and rotates the separation roller unit 40. For example, the exchanger may rotate the separation roller unit 40 by moving the protrusion 41A with a finger.

FIGS. 15A and 15B illustrate an end part in the Y1 direction of the separation roller unit 40, and the same operation is performed even at an end part in the Y2 direction of the separation roller unit 40.

When the separation roller unit 40 rotates up to the upper swing limit, the tip surface 42*e* of the first snap fit joint 42*a* abuts on an upper surface of the protrusion 21*c*.

Meanwhile, since each connecting unit 42 is not elastically deformed, a width of the opening unit 42*d* remains w1.

Thereafter, as illustrated in FIG. 15B, the exchanger further rotates the holder 41 in the clockwise direction in the drawing. Here, the exchanger does not need to pull the holder 41 in the X2 direction.

When such a rotational force is applied, the first snap fit joint 42*a* is elastically deformed, such that the width of the opening unit 42*d* is expanded to w2 wider than w1.

A tip part of the second snap fit joint 42*b* slides along a lower surface of the support shaft 21*d*. Thus, the width of the opening unit 42*d* is further expanded.

Here, for example, since the exchanger applies a force to the holder 41 separated from the connecting unit 42 such as the protrusion 41A, the holder 41 forms a lever having a contact part between the tip surface 42*e* and the protrusion 21*c* as a fulcrum and a contact part between the tip part of the second snap fit joint 42*b* and the support shaft 21*d* as an action point. Therefore, the opening unit 42*d* can be opened with a light force in response to a leverage ratio in the portion of the holder 41 held by the exchanger.

For example, when the separation roller unit 40 is mounted on a stay of a related art in which the protrusion 21*c* is not provided in each support shaft 21*d* in FIGS. 15A and 15B, since the lever is not formed even though any portion of the holder 41 of the separation roller unit 40 is held, it is necessary to apply a force equal to or greater than the pull-out resistance to elastically deform the connecting unit 42 and pull the connecting unit 42 out from the support shaft 21*d*.

According to a removal method of the embodiment, a load on the exchanger can be reduced as compared with such a removal method of a related art.

According to the removal method of the related art, since the separation roller unit 40 is accelerated in a pull-out direction by a pull-out force at the moment when the connecting unit 42 is pulled out from the support shaft 21*d*, there is also a possibility that the hand of the exchanger placed in the pull-out direction may collide with a member in the apparatus.

On the other hand, according to the removal method of the embodiment, since the separation roller unit 40 moves in a rotational direction when the second snap fit joint 42*b* is detached from the support shaft 21*d*, the exchanger's hand is prevented from colliding with other members in the apparatus even though the force is applied.

In the removal method of the related art, the exchanger tends to grip the surface of the separation roller so that the force can be easily applied at the time of the attachment and detachment. Here, there is a possibility that the surface of the separation roller to be mounted may be damaged.

On the other hand, it is also known to form a thin wall part thinner than the width of the opening unit of the joint on a swing support shaft and to attach and detach the joint through the thin wall part. Here, since an area of a cylindrical outer peripheral surface of a rotating support shaft is reduced, there is a possibility that stable swing performance may deteriorate, such that, for example, the swing center is easily shifted.

The strength of the rotating support shaft is reduced by the thin wall part. Since the separation roller under the operation always receives an external force from the sheet feeding roller or the sheet, there is a possibility that the rotating support shaft may be easily broken. Even when an unexpected external force is applied at the time of the replacement work, there is a possibility that the rotating support shaft may be easily broken.

According to the removal method of the embodiment, the above-described problems of the related art can be prevented.

When the width w2 of the opening unit 42*d* reaches d1, each connecting unit 42 moves in the rotation direction and is detached from each support shaft 21*d*. Thus, the separation roller unit 40 is removed.

In the above-description, in order to easily understand the action, the operation of rotating the holder 14 is described by being divided into a first operation in which the tip surface 42*e* abuts on the protrusion 21*c* and a second operation in which the holder 14 is further rotated to elastically deform the connecting unit 42. However, it is not necessary to separately execute the first operation and the second operation. The exchanger can continuously perform the first operation and the second operation.

As described above, the separation roller unit 40 of the embodiment can be easily removed even in the printer unit 3 by the exchanger. However, the separation roller unit 40 may be removed from the cassette sheet feeding unit 21 at the outside of the printer unit 3 as described above after the cassette sheet feeding unit 21 is removed from the printer unit 3.

Although not particularly illustrated, when the separation roller unit 40 is mounted, the above-described operation may be reversed. Here, since the holder 14 functions as a lever, the mounting can be performed with a lower load than that of the removal method of the related art performed in the reverse order.

However, the exchanger may mount the separation roller unit 40 by performing the removal method of the related art in the reverse order. Here, since a force acts on the holder 14 in the pushing direction, the mounting can be easily performed even with the same load as compared with the pulling out. Since the position of the separation roller unit 40 is fixed when the mounting is completed, there is little possibility that the hand of the exchanger collides with other members in the apparatus.

Next, a method of replacing the separation roller unit 13 will be described with reference to FIGS. 11, 16, and 17.

Figure 16:
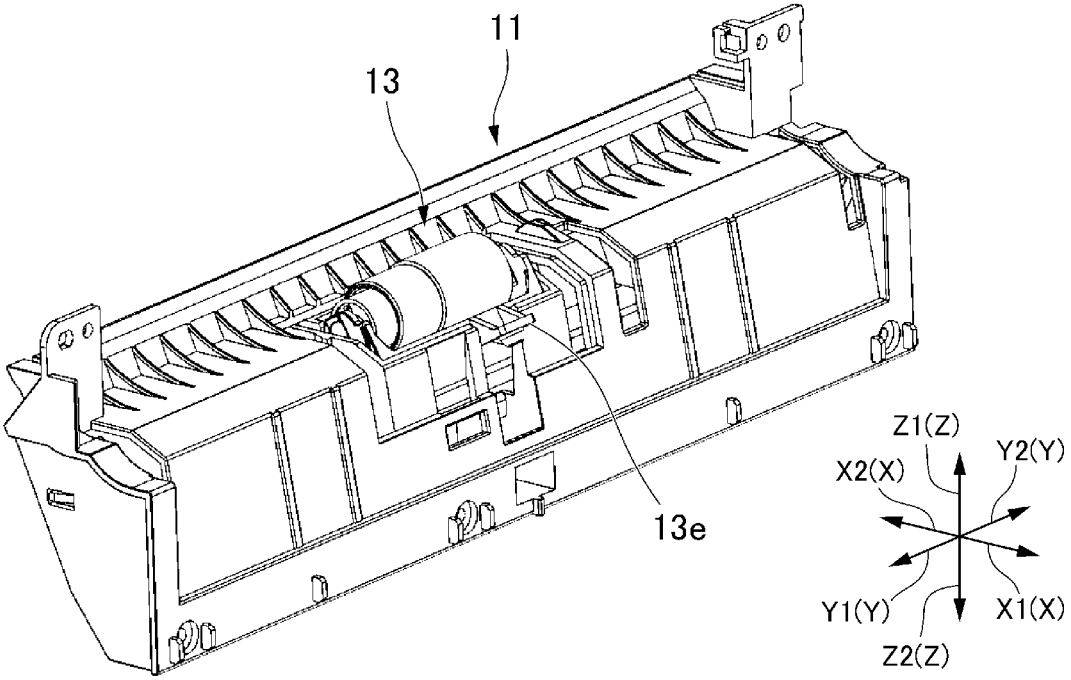
FIG. 16 is a schematic perspective view illustrating a removal operation of a connecting member in the manual sheet feeding unit.
Figure 17:
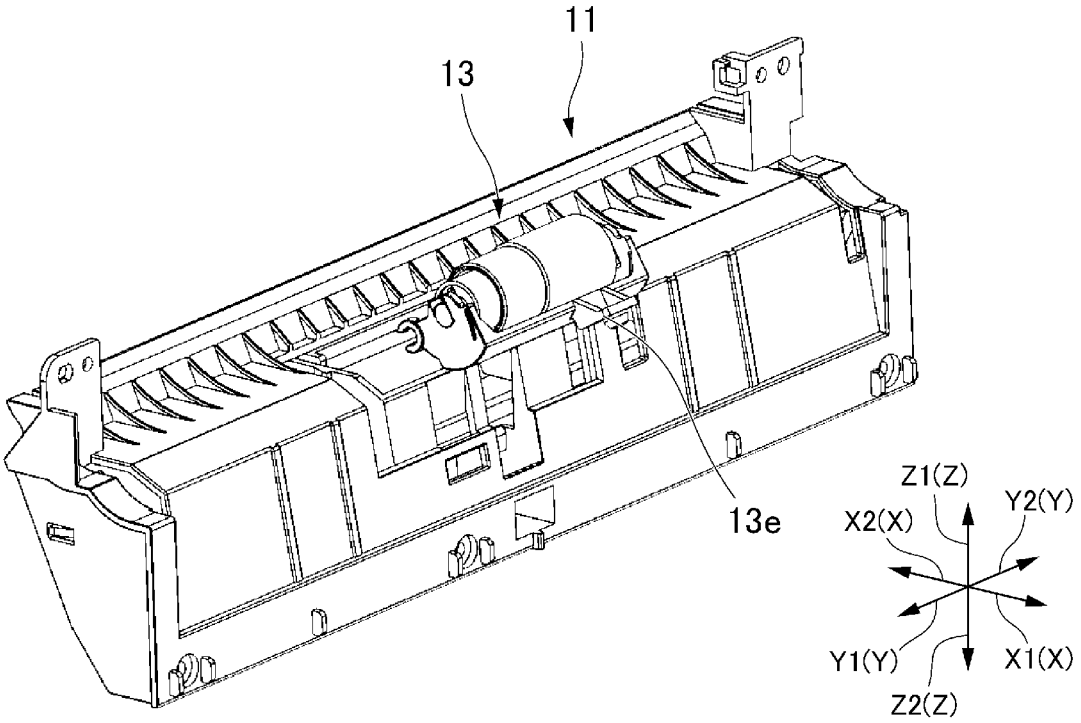
FIG. 17 is a schematic perspective view illustrating the removal operation of the connecting member in the manual sheet feeding unit.

FIGS. 16 and 17 are schematic perspective views illustrating the removal operation of the connecting member in the manual sheet feeding unit in the image forming apparatus of the embodiment.

The separation roller unit 13 can be removed from the manual sheet feeding unit 11 in the same manner as that of the separation roller unit 40. However, a removal direction is different depending on a difference in arrangement of the separation roller unit 13 in the manual sheet feeding unit 11.

The exchanger first removes the manual feeding tray 10*a*, the manual sheet feeding roller unit 12, and the lid 11*m* (refer to FIG. 11).

Thereafter, as illustrated in FIG. 16, the exchanger rotates the separation roller unit 13 upward by holding the spring locking unit 13*e*. Accordingly, the first operation and the second operation similar to the operations described above are performed. As a result, as illustrated in FIG. 17, the separation roller unit 13 is removed from the manual sheet feeding unit 11.

In FIGS. 16 and 17, for simplicity, illustration of the members such as the side cover 3*a* and the inner cover 11*a* is omitted. The replacement operation described above can be performed without removing the manual sheet feeding unit 11 from the printer unit 3.

In FIGS. 16 and 17, illustration of the coil spring 53 is also omitted. The coil spring 53 may be removed together with the separation roller unit 13, or may be separated from the spring locking unit 13*e* and remain in the manual sheet feeding unit 11.

Since the separation roller unit 13 and the manual sheet feeding unit 11 are connected to each other via the connecting unit 15 and the support shaft 11*d* which are the same as the connecting unit 42 and the support shaft 21*d*, the action in the attaching and detaching operation is also the same as that of the separation roller unit 40.

In the separation roller units 13 and 40, a straight line connecting the center axis O42 and the center axis O43 is inclined toward the Z2 direction by an angle ϕ with respect to the center lines C11*d* and C42*d* of the protrusions 11*c* and 21*c*.

In the case of the manual sheet feeding unit 11, since a wide range at the upper part is opened, the replacement can be easily performed without removing the manual sheet feeding unit 11.

In the manual sheet feeding unit 11, since the separation roller unit housing unit 11A includes the fourth wall body 11*i*, the holder 14 cannot be moved in the X1 direction. Therefore, the removal method of the related art and the mounting method in the reverse order cannot be executed.

As illustrated in FIG. 14A, particularly, in the case of the separation roller unit 13, the spring locking unit 13*e* is disposed in the X1 direction further than the protrusion 41A in the separation roller unit 40. Therefore, since the exchanger has the spring locking unit 13*e*, a rotation radius of a force point becomes large as compared with a case where the separation roller unit 40 includes the protrusion 41A. Therefore, a leverage ratio becomes larger. The exchanger can remove the separation roller unit 13 more easily than the separation roller unit 40.

As described above, according to the image forming apparatus 100 of the embodiment, the separation roller 43 can be easily attached and detached.

Each protrusion 21*c* protrudes from each support shaft 21*d*, and respectively connects the third wall body 21*h* and the first wall body 21*f*F to the third wall body 21*h* and the second wall body 21*f*B. Therefore, each protrusion 21*c* and each support shaft 21*d* are reinforced by the first wall body

21/F, the second wall body 21/B, and the third wall body 21*h*. Therefore, even though the thickness of the protrusion 21*c* and the outer diameter of the support shaft 21*d* are small, the protrusion 21*c* and the support shaft 21*d* are not easily broken by the external force at the time of attachment and detachment.

The same also applies to each protrusion 11*c* and each support shaft 11*d* in the separation roller unit 13.

Therefore, when the stays 21*b* and 11*b* are formed by resin molding, the protrusions 21*c* and 11*c* and the support shafts 21*d* and 11*d* can also be formed by resin molding.

According to at least one embodiment described above, it is possible to provide an image forming apparatus capable of easily attaching and detaching the separation roller.

Hereinafter, modifications of the above-described embodiments will be described.

In the description of the embodiment, it is described that the rotation separation method is adopted for both the manual sheet feeding unit 11 and the cassette sheet feeding unit 21. However, the rotation separation method may be used for at least one of the manual sheet feeding unit 11 and the cassette sheet feeding unit 21.

When a separation method other than the rotation separation method is used for one sheet feeding unit, for example, a corner claw method, a separation pad method, and a separation roller method may be used.

In the description of the embodiment, it is described that the detachable member is energized by the tension coil spring or the compression coil spring. However, the detachable member may be energized by a spring other than the coil spring.

In the description of the embodiment, it is described that the holder of the separation roller is energized by the spring. However, the holder may not be energized by the spring. For example, when the holder is formed of an elastically deformable material and the elastic deformation of the connecting member can be reduced to such an extent that the connecting member is not removed from the support shaft, instead of the spring, the separation roller may be energized against the sheet feeding roller by the elastic restoring force due to elastic deformation of the holder itself.

In the description of the embodiment, it is described that the detachable member is energized by the spring. However, when the detachable member is only required to be detachably mounted on any portion of the image forming apparatus, the detachable member may not be energized by the spring.

In the description of the embodiment, it is described that the support shaft, the connecting member, and the detachable member are provided in the sheet feeding unit including the sheet feeding roller and the separation roller. However, the support shaft, the connecting member, and the detachable member may be provided other than the sheet feeding unit in the image forming apparatus. Here, the detachable member may not include any roller including the separation roller, and may include the roller other than the separation roller.

When the roller is not included, the detachable member may not include the roller housing unit that houses the roller.

In the description of the embodiment, the connecting member includes the first snap fit joint and the second snap fit joint, and the connecting member has a C-shape when viewed from the first direction. However, when the shape of the inner peripheral surface of the first snap fit joint and the second snap fit joint is a circular arc shape when viewed from the first direction, the shape of the outer peripheral surface may not be a circular arc shape.

The first snap fit joint and the second snap fit joint are not particularly limited as long as the first snap fit joint and the second snap fit joint are elastically deformed when the detachable member is removed, and have a shape capable of being connected coaxially with the center axis of the support shaft at the time of mounting. For example, when the inner peripheral surfaces of the first snap fit joint and the second snap fit joint are a circular arc shape when viewed from the first direction, it is more desirable because the surface can contact the support shaft.

However, the inner peripheral surfaces of the first snap fit joint and the second snap fit joint may be formed by a plane or a curved surface that can perform line contact in the circumferential direction or the axial direction of the support shaft.

In the description of the embodiment, it is described that the respective tip parts of the first snap fit joint and the second snap fit joint in the connecting member are opposite to each other in the circumferential direction. However, the first snap fit joint and the second snap fit joint may be disposed at positions different from each other in the axial direction of the support shaft.

In the description of the embodiment, it is described that the connecting member is formed of the first connecting member and the second connecting member, and corresponding thereto, the support shaft and the protrusion also respectively include the first support shaft, the second support shaft, the first protrusion, and the second protrusion. However, the number of the connecting members, the support shafts, and the protrusions may be respectively at least one and is not limited to two. For example, each one may be formed with one, or may be formed with three or more.

For example, at least one of the support shaft and the protrusion may be one with respect to the plurality of connecting members.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a support shaft that extends in a first direction and comprises a protrusion protruding in a second direction orthogonal to the first direction;

a connecting member comprising an elastic material and connected to the support shaft to interpose the protrusion therebetween and surround an outer periphery of the support shaft;

a separation roller unit detachably connected to the support shaft via the connecting member; and a sheet feeding component comprising a sheet feeding roller and a separation roller for feeding and separating a sheet, wherein the support shaft, the connecting member, and the separation roller unit are provided in the sheet feeding component, the separation roller unit holds the separation roller at a position opposite to the sheet feeding roller disposed in a conveyance path of the sheet, the connecting member is swingable around the support shaft and, while the connecting member is swinging with the separation roller unit removed from the image forming apparatus, the connecting member comes into contact with the protrusion, and the connecting member elastically deforms, the connecting member comprises a first snap joint and a second snap joint that interpose the support shaft and are positioned opposite to each other, tip parts of the first snap joint and the second snap joint form a gap that is wider than a width of the protrusion in a circumferential direction of the support shaft and narrower than an outer diameter of the support shaft when viewed from the first direction, the separation roller unit is connected in a swingable manner around the support shaft, each inner peripheral surface of the first snap joint and the second snap joint is formed in a circular arc shape when viewed from the first direction, and an outer peripheral surface excluding the protrusion in the support shaft is formed of a cylindrical surface slidably fitted to each inner peripheral surface.

2. The image forming apparatus according to claim 1, wherein when viewed from the first direction, a distance from a center line of the gap to each of the tip parts increases from the inside toward the outside in a radial direction of the support shaft.

3. The image forming apparatus according to claim 1, further comprising:

the separation roller unit further comprises a holder for holding the separation roller at a position opposite to the sheet feeding roller disposed in a conveyance path of the sheet.

4. The image forming apparatus according to claim 3, wherein the connecting member comprises a first connecting member and a second connecting member that are provided at both end parts in a longitudinal direction of the separation roller in the holder, the support shaft comprises a first support shaft and a second support shaft that are disposed apart in the longitudinal direction and are coaxial with each other, and the protrusions are respectively provided on the first support shaft and the second support shaft.

5. The image forming apparatus according to claim 4, wherein the sheet feeding component further comprises a stay provided with a detachable member housing structure for housing the separation roller unit, the detachable member housing structure includes a first wall body on which the first support shaft is erected, a second wall body on which the second support shaft is erected, and a third wall body disposed between the first wall body and the second wall body, the first protrusion connects the first support shaft and at least one of the first wall body and the third wall body, and the second protrusion connects the second support shaft and at least one of the second wall body and the third wall body.

6. The image forming apparatus according to claim 3, wherein the sheet feeding component further comprises a spring that energizes the holder, and the spring energizes the holder in a direction in which the separation roller presses the sheet feeding roller.

7. A sheet conveying apparatus, comprising:

a support shaft that extends in a first direction and comprises a protrusion protruding in a second direction orthogonal to the first direction;

a connecting member comprising an elastic material and connected to the support shaft to interpose the protrusion therebetween and surround an outer periphery of the support shaft;

a separation roller unit detachably connected to the support shaft via the connecting member; and a sheet feeding component comprising a sheet feeding roller and a separation roller for feeding and separating a sheet, wherein the support shaft, the connecting member, and the separation roller unit are provided in the sheet feeding component, the separation roller unit holds the separation roller at a position opposite to the sheet feeding roller disposed in a conveyance path of the sheet, the connecting member is swingable around the support shaft, while the connecting member is swinging with the separation roller unit removed from the sheet conveying apparatus, the connecting member comes into contact with the protrusion, and the connecting member elastically deforms, the connecting member comprises a first snap joint and a second snap joint that interpose the support shaft and are positioned opposite to each other, tip parts of the first snap joint and the second snap joint form a gap that is wider than a width of the protrusion in a circumferential direction of the support shaft and narrower than an outer diameter of the support shaft when viewed from the first direction, the separation roller unit is connected in a swingable manner around the support shaft, each inner peripheral surface of the first snap joint and the second snap joint is formed in a circular arc shape when viewed from the first direction, and an outer peripheral surface excluding the protrusion in the support shaft is formed of a cylindrical surface slidably fitted to each inner peripheral surface.

8. The sheet conveying apparatus according to claim 7, wherein when viewed from the first direction, a distance from a center line of the gap to each of the tip parts increases from the inside toward the outside in a radial direction of the support shaft.

9. A sheet handling apparatus, comprising:

a support shaft that extends in a first direction and comprises a protrusion protruding in a second direction orthogonal to the first direction;

a connecting member comprising an elastic material and connected to the support shaft to interpose the protrusion therebetween and surround an outer periphery of the support shaft; and a separation roller unit detachably connected to the support shaft via the connecting member; and a sheet feeding component comprising a sheet feeding roller and a separation roller for feeding and separating a sheet, wherein the support shaft, the connecting member, and the separation roller unit are provided in the sheet feeding component, the separation roller unit holds the separation roller at a position opposite to the sheet feeding roller disposed in a conveyance path of the sheet, the connecting member is swingable around the support shaft, while the connecting member is swinging with the separation roller unit removed from the sheet handling apparatus, the connecting member comes into contact with the protrusion, and the connecting member elastically deforms, the connecting member comprises a first snap joint and a second snap joint that interpose the support shaft and are positioned opposite to each other, tip parts of the first snap joint and the second snap joint form a gap that is wider than a width of the protrusion in a circumferential direction of the support shaft and narrower than an outer diameter of the support shaft when viewed from the first direction, the separation roller unit is connected in a swingable manner around the support shaft;

each inner peripheral surface of the first snap joint and the second snap joint is formed in a circular arc shape when viewed from the first direction, and an outer peripheral surface excluding the protrusion in the support shaft is formed of a cylindrical surface slidably fitted to each inner peripheral surface.

10. The sheet handling apparatus according to claim 9, further comprising:

the separation roller unit further comprises a holder for holding the separation roller at a position opposite to the sheet feeding roller disposed in a conveyance path of the sheet.

11. The sheet handling apparatus according to claim 10, wherein the connecting member comprises a first connecting member and a second connecting member that are provided at both end parts in a longitudinal direction of the separation roller in the holder, the support shaft comprises a first support shaft and a second support shaft that are disposed apart in the longitudinal direction and are coaxial with each other, and the protrusions are respectively provided on the first support shaft and the second support shaft.

12. The sheet handling apparatus according to claim 11, wherein the sheet feeding component further comprises a stay provided with a detachable member housing structure for housing the separation roller unit, the detachable member housing structure includes a first wall body on which the first support shaft is erected, a second wall body on which the second support shaft is erected, and a third wall body disposed between the first wall body and the second wall body, the first protrusion connects the first support shaft and at least one of the first wall body and the third wall body, and the second protrusion connects the second support shaft and at least one of the second wall body and the third wall body.

13. The sheet handling apparatus according to claim 10, wherein the sheet feeding component further comprises a spring that energizes the holder, and the spring energizes the holder in a direction in which the separation roller presses the sheet feeding roller.

* * * * *